US011195377B2

(12) United States Patent
Sanborn et al.

(10) Patent No.: US 11,195,377 B2
(45) **Date of Patent: *Dec. 7, 2021**

(54) CONTROLLING AN ELECTRONIC GAMING MACHINE TO PROVIDE A PRIZE ON SYMBOL TRIGGER

(71) Applicant: Aristocrat Technologies, Inc., Las Vegas, NV (US)

(72) Inventors: Hanna Sanborn, Georgetown, TX (US); Erick Ching, Cedar Park, TX (US); Chad La Guardia, Austin, TX (US); Nathan Warms, Austin, TX (US); Zachary Smith, Austin, TX (US); Scott Hopkins, Austin, TX (US); Jennifer Mizzi, Round Rock, TX (US); Rogelio Decasa, Jr., Renton, WA (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/947,838

(22) Filed: Aug. 19, 2020

(65) Prior Publication Data

US 2020/0380827 A1 Dec. 3, 2020

Related U.S. Application Data

(63) Continuation-in-part of application No. 16/283,426, filed on Feb. 22, 2019, now Pat. No. 10,789,812.

(51) Int. Cl.
*A63F 9/24* (2006.01)
*G07F 17/32* (2006.01)

(52) U.S. Cl.
CPC ..... *G07F 17/3258* (2013.01); *G07F 17/3213* (2013.01); *G07F 17/3267* (2013.01)

(58) Field of Classification Search
CPC .. G07F 17/34; G07F 17/3213; G07F 17/3258; G07F 17/3265; G07F 17/3267;
(Continued)

(56) References Cited

U.S. PATENT DOCUMENTS

D58,098 S 6/1921 Morrill
D74,987 S 4/1928 Poulton
(Continued)

OTHER PUBLICATIONS

"First class player experience," Asia Gaming Brief, Jul. 31, 2018, 3 pages.

(Continued)

*Primary Examiner* — Justin L Myhr
(74) *Attorney, Agent, or Firm* — Weaver Austin Villeneuve & Sampson LLP

(57) ABSTRACT

An electronic gaming machine (EGM) or another type of gaming device may be configured to provide games that involve "WYSIWYG" (what you see is what you get) symbols or "prize on" symbols. The gaming device may be configured to provide the value of all "prize on" symbols that land during a single instance of a game if a prize on trigger symbol, which also may be referred to herein as a blast symbol, lands during the same instance of the game. In some examples, the game may be a base game. According to some examples, a feature does not need to be triggered during the instance of the base game for the value of all prize on symbols that land during the instance of the base game to be awarded. In other examples, the game may be a feature game, such as a "hold and spin" game.

21 Claims, 19 Drawing Sheets

(58) Field of Classification Search
CPC ..... G07F 17/3211; G07F 17/323; G07F 17/3255; G07F 17/3262
See application file for complete search history.

(56) References Cited

U.S. PATENT DOCUMENTS

| | | | | |
|---|---|---|---|---|
| D75,987 | S | 8/1928 | Schelb | |
| D154,827 | S | 8/1949 | Wells | |
| D194,142 | S | 11/1962 | Kasser | |
| D408,868 | S | 4/1999 | Floge | |
| D524,322 | S | 7/2006 | Braff | |
| D599,370 | S | 9/2009 | Murchie | |
| D600,711 | S | 9/2009 | LaManna | |
| 7,806,121 | B2 | 10/2010 | Bodduluri | |
| D644,246 | S | 8/2011 | Matas | |
| D664,209 | S | 7/2012 | Bengyak | |
| D675,228 | S | 1/2013 | Frost | |
| D681,737 | S | 5/2013 | Bengyak | |
| D716,823 | S | 11/2014 | Wood | |
| D717,310 | S | 11/2014 | Fino | |
| D743,973 | S | 11/2015 | Ahn | |
| D744,500 | S | 12/2015 | Lee | |
| D745,028 | S | 12/2015 | Hwang | |
| D763,871 | S | 8/2016 | Yang | |
| D769,900 | S | 10/2016 | Kim | |
| D780,774 | S | 3/2017 | Lee | |
| D780,782 | S | 3/2017 | Minks-Brown | |
| D790,575 | S | 6/2017 | Anzures | |
| D800,756 | S | 10/2017 | Kim | |
| D831,067 | S | 10/2018 | Ekstrand | |
| D840,416 | S | 2/2019 | Saad Ahmed | |
| D846,560 | S | 4/2019 | Ekstrand | |
| D846,570 | S | 4/2019 | Ekstrand | |
| D846,573 | S | 4/2019 | Ekstrand | |
| D847,150 | S | 4/2019 | Joo | |
| D852,209 | S | 6/2019 | Wei | |
| D852,820 | S | 7/2019 | Sanchez | |
| D852,842 | S | 7/2019 | Hung | |
| D855,649 | S | 8/2019 | Akagawa | |
| D862,490 | S | 10/2019 | Huang | |
| D867,397 | S | 11/2019 | De Regt | |
| D878,420 | S | 3/2020 | Dedonato | |
| D884,011 | S | 5/2020 | Krenkler | |
| D884,012 | S | 5/2020 | Krenkler | |
| D884,722 | S | 5/2020 | Kim | |
| 2003/0157981 | A1 | 8/2003 | Marks | |
| 2004/0048646 | A1 | 3/2004 | Visocnik | |
| 2005/0070354 | A1* | 3/2005 | Baerlocher ..... | G07F 17/3244 463/20 |
| 2005/0119047 | A1 | 6/2005 | Olive | |
| 2005/0266911 | A1 | 12/2005 | Kojima | |
| 2006/0030390 | A1 | 2/2006 | Okada | |
| 2007/0060265 | A1 | 3/2007 | Marks | |
| 2008/0318662 | A1 | 12/2008 | Yoshizawa | |
| 2012/0258790 | A1 | 10/2012 | Gomez | |
| 2012/0295689 | A1 | 11/2012 | Owen | |
| 2012/0297320 | A1 | 11/2012 | Lemmey | |
| 2015/0141114 | A1 | 5/2015 | Davis | |
| 2016/0302717 | A1 | 10/2016 | Tawa | |
| 2017/0024955 | A1 | 1/2017 | Pawloski | |
| 2019/0206183 | A1 | 7/2019 | Hiten | |

OTHER PUBLICATIONS

"Scientific Games Brings Stellar Line-Up Of Market-Leading Innovation, Technology And Digital Solutions To Australasian Gaming Expo," PRNewswire, Aug. 6, 2018, 10 pages.

Circle Fire for Agar Edit, by Gota, YouTube [online], published on Nov. 5, 2017, [retrieved on Mar. 9, 2020], retrieved from the Internet <U RL: https://www.youtube.com/watch?v=qbAduVZdzoA> (Year: 2017).

The Cpt. Obvious Intro, by Russell, YouTube [online], published on Oct. 25, 2009, [retrieved on Mar. 10, 2020], retrieved from the Internet <URL: https://www.youtube.com/watch?v=C0Axs5FeC9U> (Year: 2009).

Hat Tip GIF, by KidDerry, tenor.com [online], published on Feb. 10, 2018, [retrieved on Mar. 9, 2020], retrieved from the Internet <URL: https://tenor.conn/view/hat-tip-gif-11048773> (Year: 2018).

Electricity Border Vertical 1 Symmetrical Stock Footage Video, by Kerempooh, shutterstock.com [online], published on Jan. 22, 2014, [retrieved on Mar. 10, 2020], retrieved from the Internet <URL: https://www.shutterstock.conn/video/clip-5440043-electricity-border-vertical-1-symmetrical> (Year: 2014).

Fortnite, by Just a man, YouTube [online], published on Feb. 16, 2020, [retrieved on Mar. 9, 2020], retrieved from the Internet <URL: https://www youtube.com/watch?v= mPsDhESg10> (Year: 2019).

Full Throttle Saloon Images GIF, giphy.com [online], published on Sep. 9, 2015, [retrieved on Mar. 6, 2020], retrieved from the Internet <URL: https://giphy.conn/gifs/innages-saloon-full-throttle-tgjr9nnBbN6ujK> (Year: 2015).

Round Magic Electricity Energy White Stock Footage Video, by Multi Animation, published on May 31, 2018, [retrieved an Mar. 9, 2020 ], retrieved from the Internet <URL: https://www.shutterstock.corn/video/clip-1012141547-round-magic-electricity-energy-white-lightning-rays> (Year: 2018).

West Cowboy 74%, by Elettronica Video Games, YouTube [online], published on Apr. 22, 2013, [retrieved on Mar. 6, 2020], retrieved from the Internet <URL: https://www youtube.conn/watch?v= 0gUAIz3wCIA> (Year: 2013).

Wild West Slots, by FupaGames, YouTube [online], published on Jan. 2, 2014, [retrieved on Mar. 6, 2020], retrieved from the Internet <URL: https://www.youtube.conn/watch?v=xywg30aNICO> (Year: 2014).

Wild Wild Slot @ DoubleU Casino, by Taylor, YouTube [online], published on Apr. 23, 2013, [retrieved on Mar. 6, 2020], retrieved from the Internet <URL: https://www.youtube.conn/watch?v= LPWpuNq8ack> (Year: 2013).

US Unpublished U.S. Appl. No. 29/681,215, filed Feb. 22, 2019, Inventor Sanborn et al.

US Unpublished U.S. Appl. No. 29/681,216, filed Feb. 22, 2019, Inventor Sanborn et al.

US Unpublished U.S. Appl. No. 29/681,218, filed Feb. 22, 2019, Inventor Sanborn et al.

US Unpublished U.S. Appl. No. 29/681,221, filed Feb. 22, 2019, Inventor Sanborn et al.

Office Action dated Mar. 12, 2020, for U.S. Appl. No. 29/681,215 (pp. 1-10).

Office Action dated Mar. 12, 2020, for U.S. Appl. No. 29/681,216 (pp. 1-10).

Office Action dated Mar. 13, 2020, for U.S. Appl. No. 29/681,218 (pp. 1-11).

Office Action dated Mar. 13, 2020, for U.S. Appl. No. 29/681,221 (pp. 1-10).

Digital Animation of Lightning Ring Stock Footage Video, by Sky Motion, published on Jun. 30, 2016, [retrieved on Mar. 9, 2020], retrieved from the Internet <URL: https://www.shutterstock.corn/video/clip-18410419-digital-animation-lightning-ring> (Year: 2016).

Office Action dated Dec. 27, 2020 for U.S. Appl. No. 16/283,426 (pp. 1-12).

Notice of Allowance dated Jun. 4, 2020 for U.S. Appl. No. 16/283,426 (pp. 1-9).

Notice of Allowance dated Jun. 10, 2020 for U.S. Appl. No. 29/681,218 (pp. 1-9).

Notice of Allowance dated Jun. 11, 2020 for U.S. Appl. No. 29/681,215 (pp. 1-5).

Notice of Allowance dated Jun. 11, 2020 for U.S. Appl. No. 29/681,216 (pp. 1-5).

Notice of Allowance dated Jun. 12, 2020 for U.S. Appl. No. 29/681,221 (pp. 1-5).

* cited by examiner

600

CONTROLLING AN ELECTRONIC GAMING MACHINE TO PROVIDE A PRIZE ON SYMBOL TRIGGER

CROSS-REFERENCE TO RELATED APPLICATIONS

This application claims priority to, and is a continuation-in-part of, U.S. patent application Ser. No. 16/283,426, entitled "CONTROLLING AN ELECTRONIC GAMING MACHINE TO PROVIDE A "PRIZE ON" SYMBOL TRIGGER" and filed on Feb. 22, 2019, which is hereby incorporated by reference and for all purposes. This application is related to U.S. patent application Ser. No. 29/681,215, entitled "ANIMATED SYMBOLS, COWBOY, WILDS ON FIRE, CHARGED INDEPENDENT REEL FRAME" and filed on Feb. 22, 2019, to U.S. patent application Ser. No. 29/681,216, entitled "LONG HORN SKULL ANIMATION" and filed on Feb. 22, 2019, to U.S. patent application Ser. No. 29/681,218, entitled "ELECTRIC PRIZE ON SYMBOL ANIMATION" and filed on Feb. 22, 2019, and to U.S. patent application Ser. No. 29/681,221, entitled "ELECTRIC BURST SYMBOL FRAME ANIMATION" and filed on Feb. 22, 2019, all of which are hereby incorporated by reference and for all purposes.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

At least some aspects of the present disclosure may be implemented via an apparatus. For example, one or more devices may be configured for performing, at least in part, the methods disclosed herein. In some implementations, the apparatus may be an EGM. The EGM may include a display system that includes one or more displays, an interface system including one or more user interfaces and a control system that includes one or more processors.

The interface system may include one or more network interfaces, one or more interfaces between the control system and a memory system, one or more interfaces between the control system and another device and/or one or more external device interfaces. The control system may include at least one of a general purpose single- or multi-chip processor, a digital signal processor (DSP), an application specific integrated circuit (ASIC), a field programmable gate array (FPGA) or other programmable logic device, discrete gate or transistor logic, or discrete hardware components. Accordingly, in some implementations the control system may include one or more processors and one or more non-transitory storage media operatively coupled to the one or more processors.

The control system may, for example, be configured for determining, during an instance of a game, which symbols will be presented on the display system. The symbols may include one or more "prize on" symbols and at least one prize on trigger symbol. A "prize on" symbol may also be referred to herein as a "WYSIWYG" (what you see is what you get) symbol. Prize on symbols generally provide an express indication of a prize that may potentially be won. According to some examples, each prize on symbol includes an indication of an award corresponding to the prize on symbol. For example, a prize on symbol may indicate a number corresponding to a number of game credits, a number of currency units, an award multiplier, a progressive award, etc., that may potentially be won.

The control system may be configured for controlling the display system to present first visual effects corresponding to the instance of the game. The first visual effects may, for example, include moving symbols. In some instances, the first visual effects may include the landing of one or more prize on symbols and at least one prize on trigger symbol. The control system may be configured for determining an award corresponding to the one or more prize on symbols and for controlling the display system to present second visual effects corresponding to the award.

According to some examples, the game may be a base game. In some implementations wherein the game is a base game, a feature may not be triggered during the instance of the base game.

According to some instances, the control system may determine that at least T prize on symbols land during the instance of a base game, where T corresponds to a threshold number of prize on symbols required to trigger a feature. According to some such examples, the control system may be configured for controlling the display system to present the feature after controlling the display system to present second visual effects corresponding to the award. In some implementations, the feature may involve one or more "hold and spin" bonus games. The control system may be configured for controlling the display system to display the threshold number of prize on symbols in fixed positions during presentation of the one or more "hold and spin" bonus games.

In some instances, the control system may determine that (T−1) prize on symbols land during the instance of a base game, wherein (T−1) corresponds to a number that is one less than a threshold number of prize on symbols required to trigger a feature. In some such instances, the control system may determine that the at least one prize on trigger symbol that lands during the instance of the base game, in addition to the (T−1) prize on symbols, will trigger the feature. The control system may be configured for controlling the display system to present the feature after controlling the display system to present second visual effects corresponding to the award.

According to some implementations, the game may be a free game. In some examples, the game may be a "hold and spin" bonus game. According to some examples, prior to presenting the "hold and spin" bonus game, the control system may have determined that the "hold and spin" bonus game was triggered when at least a threshold number of prize on symbols landed during an instance of a base game.

At least some aspects of the present disclosure may be implemented via methods. For example, some methods may involve determining, during an instance of a game and via a control system of an electronic gaming machine that that is presenting the game, which symbols will be presented on a display system of the electronic gaming machine. The symbols may, in some instances, include one or more prize on symbols and at least one prize on trigger symbol. Each prize on symbol may include an indication of an award corresponding to the prize on symbol.

Some such methods may involve controlling, via the control system, the display system to present first visual effects corresponding to the instance of the game. The first visual effects may, in some instances, include moving symbols, landing of one or more prize on symbols and landing at least one prize on trigger symbol. Some such methods may involve determining, via the control system, an award corresponding to the one or more prize on symbols and controlling, via the control system, the display system to present second visual effects corresponding to the award. In some examples, the prize on symbols may indicate a number of game credits, a number of currency units, an award multiplier and/or a progressive award.

According to some examples, the game may be a base game. In some implementations wherein the game is a base game, a feature may not be triggered during the instance of the base game. In alternative examples, the game may be a feature game.

In some implementations wherein the game is a base game, determining which symbols will be presented on the display system may involve determining that at least T prize on symbols land during the instance of the base game, wherein T corresponds to a threshold number of prize on symbols required to trigger a feature. The method may, in some instances, involve controlling the display system to present the feature after controlling the display system to present second visual effects corresponding to the award.

According to some implementations, the game may be a free game. In some examples, the game may be a "hold and spin" bonus game. The method may involve controlling the display system to display the threshold number of prize on symbols in fixed positions during presentation of the one or more "hold and spin" bonus games.

According to some examples, prior to presenting the "hold and spin" bonus game, the method may involve determining that the "hold and spin" bonus game was triggered when at least a threshold number of prize on symbols landed during an instance of a base game.

In some implementations wherein the game is a base game, determining which symbols will be presented on the display system may involve determining that (T−1) prize on symbols will land during the instance of the base game, (T−1) corresponding to a number that is one less than a threshold number of prize on symbols required to trigger a feature. In some instances the method may involve determining, via the control system, that the at least one prize on trigger symbol that lands during the instance of the base game, in addition to the (T−1) prize on symbols, will trigger the feature. The method may involve controlling the display system to present the feature after controlling the display system to present second visual effects corresponding to the award.

Some or all of the methods described herein may be performed by one or more devices according to instructions (e.g., software) stored on one or more non-transitory media. Such non-transitory media may include memory devices such as those described herein, including but not limited to random access memory (RAM) devices, read-only memory (ROM) devices, etc. Accordingly, various innovative aspects of the subject matter described in this disclosure can be implemented in one or more non-transitory media having software stored thereon. The software may, for example, include instructions for controlling at least one device to process audio data. The software may, for example, be executable by one or more components of a control system such as those disclosed herein. The software may, for example, include instructions for performing one or more of the methods disclosed herein.

For example, some such methods may involve determining, during an instance of a game and via a control system of an electronic gaming machine that that is presenting the game, which symbols will be presented on a display system of the electronic gaming machine. The symbols may, in some instances, include one or more prize on symbols and at least one prize on trigger symbol. Each prize on symbol may include an indication of an award corresponding to the prize on symbol.

Some such methods may involve controlling, via the control system, the display system to present first visual effects corresponding to the instance of the game. The first visual effects may, in some instances, include moving symbols, landing of one or more prize on symbols and landing at least one prize on trigger symbol. Some such methods may involve determining, via the control system, an award corresponding to the one or more prize on symbols and controlling, via the control system, the display system to present second visual effects corresponding to the award. In some examples, the prize on symbols may indicate a number of game credits, a number of currency units, an award multiplier and/or a progressive award.

According to some examples, the game may be a base game. In some implementations wherein the game is a base game, a feature may not be triggered during the instance of the base game. In alternative examples, the game may be a feature game.

In some implementations wherein the game is a base game, determining which symbols will be presented on the display system may involve determining that at least T prize on symbols land during the instance of the base game, wherein T corresponds to a threshold number of prize on symbols required to trigger a feature. The method may, in some instances, involve controlling the display system to present the feature after controlling the display system to present second visual effects corresponding to the award.

According to some implementations, the game may be a free game. In some examples, the game may be a "hold and spin" bonus game. The method may involve controlling the display system to display the threshold number of prize on symbols in fixed positions during presentation of the one or more "hold and spin" bonus games.

According to some examples, prior to presenting the "hold and spin" bonus game, the method may involve determining that the "hold and spin" bonus game was triggered when at least a threshold number of prize on symbols landed during an instance of a base game.

In some implementations wherein the game is a base game, determining which symbols will be presented on the display system may involve determining that (T−1) prize on symbols will land during the instance of the base game, (T−1) corresponding to a number that is one less than a threshold number of prize on symbols required to trigger a feature. In some instances the method may involve determining, via the control system, that the at least one prize on trigger symbol that lands during the instance of the base game, in addition to the (T−1) prize on symbols, will trigger the feature. The method may involve controlling the display system to present the feature after controlling the display system to present second visual effects corresponding to the award.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale. Like reference numbers and designations in the various drawings generally indicate like elements.

DETAILED DESCRIPTION

Figure 1:
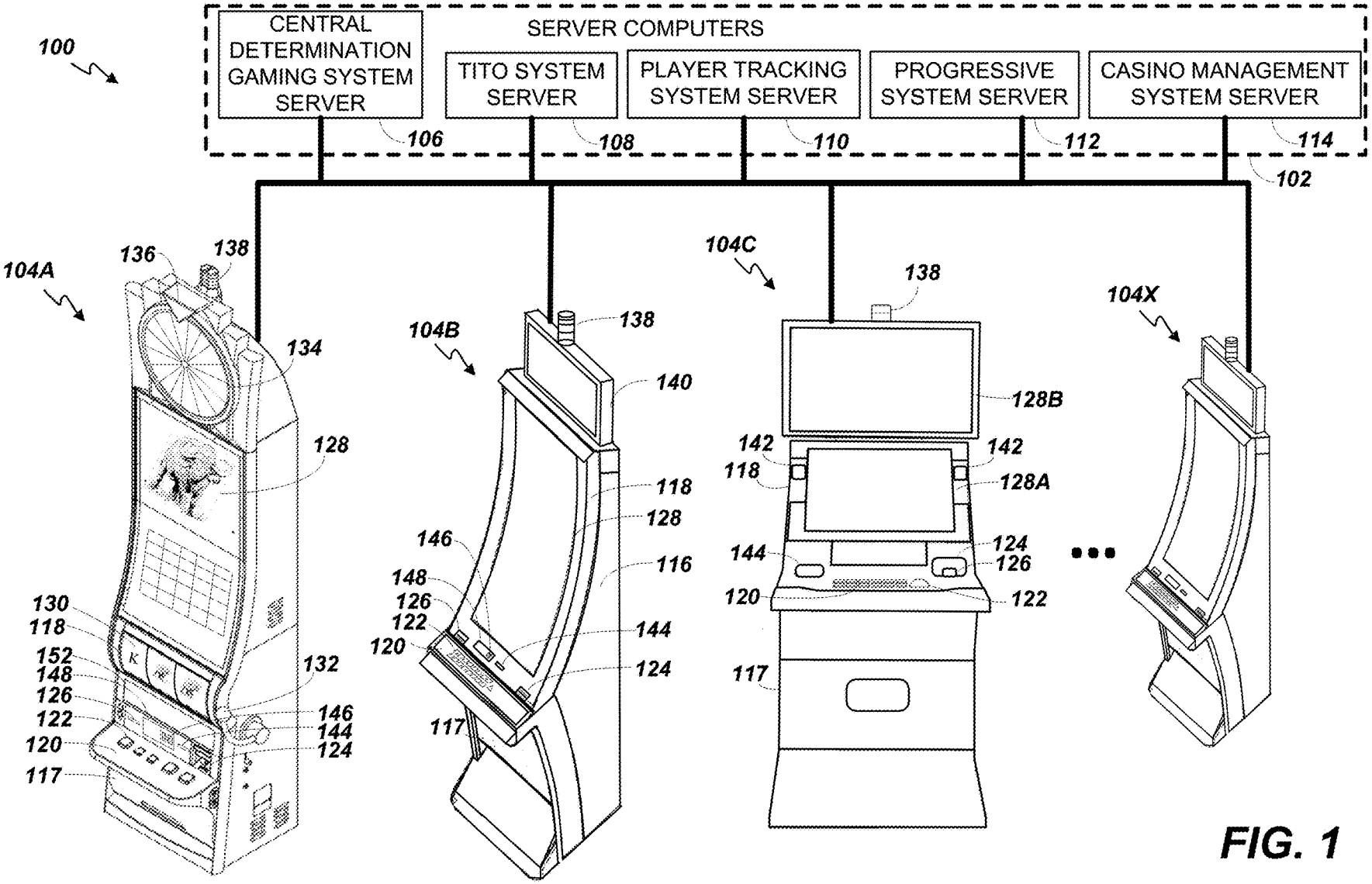
FIG. 1 is a diagram showing examples of several EGMs networked with various gaming related servers.

FIG. 1 illustrates several different models of EGMs which may be networked to various gaming related servers. The present invention can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices. Some examples are described below.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the present invention may, in one or more embodiments, be practiced on a stand-alone gaming device such as gaming device 104A, gaming device 104B or any of the other gaming devices 104C-104X. However, it is typical to find multiple EGMs connected to networks implemented with one or more of the different server computers 102 described herein.

Moreover, in some implementations at least some of the EGMs may be "thin-client" or "thick-client" EGMs that are not configured for stand-alone determination of game outcomes, etc. Such client EGMs may be configured for communication with one or more of the different server computers 102 described herein, including but not limited to the central determination gaming system server 106. Some such client EGMs may, for example, be configured to accept tickets and/or cash (e.g., via a bill validator that also functions as a ticket reader) to load credits onto the client EGM, a "ticket-out" printer for outputting a credit ticket when a cash out button is pressed, a player tracking card reader, etc. Some client EGMs may include a transceiver for wireless communication with a player's mobile device, (e.g., for communication with a player's smartphone, tablet and/or mobile gaming device) a keypad 146, and/or an illuminated display 148 for reading, receiving, entering, and/or displaying player tracking information. A client EGM may include a display system, an audio system, etc., for presenting attract sequences, game presentations, etc. The game presentations may include game outcomes determined by another device, such as the central determination gaming system server 106.

The server computers 102 may include a central determination gaming system server 106, a Class II bingo server (not shown), a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 117 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to present or determine an outcome to the game.

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor. The main display 128 may be a touchscreen display.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
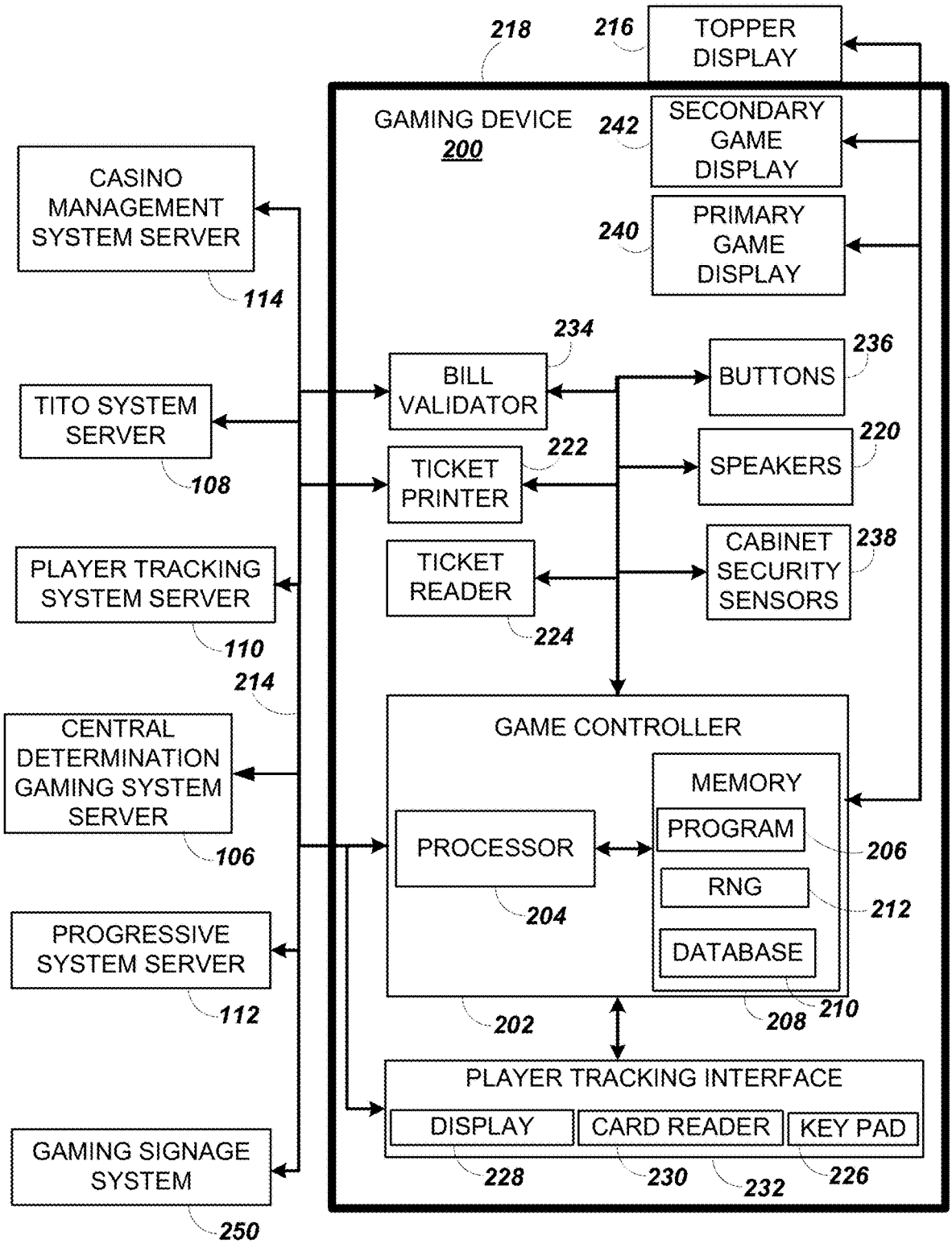
FIG. 2 is a block diagram showing examples of various functional elements of an EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the present invention necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 117 which opens to provide access to the interior of the gaming device 104B. The main or service door 117 is typically used by service personnel to refill the ticket-out printer 126 and collect bills and tickets inserted into the bill validator 124. The door 117 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class II or Class III, etc.

FIG. 2 is a block diagram depicting examples of internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

Alternatively, a game instance (i.e. a play or round of the game) may be generated on a remote gaming device such as the central determination gaming system server 106. The game instance may be communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), and a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

In this example, the gaming device 200 is also configured for communication with a gaming signage system 250 via the network 214. Various examples of gaming signage systems 250 are provided herein. According to some examples, the gaming signage system 250 may be configured for communication with other elements of a gaming system via the network 214, such as the central determination gaming system server 106, the progressive system server 112, the player tracking system server 110 the casino management system server 114 and/or the TITO system server 108.

When the player is done, he/she cashes out the credit balance (typically by pressing a cash out button to receive a ticket from the ticket printer 222). The ticket may be redeemed for money or inserted into another machine to establish a credit balance for play.

Figure 3:
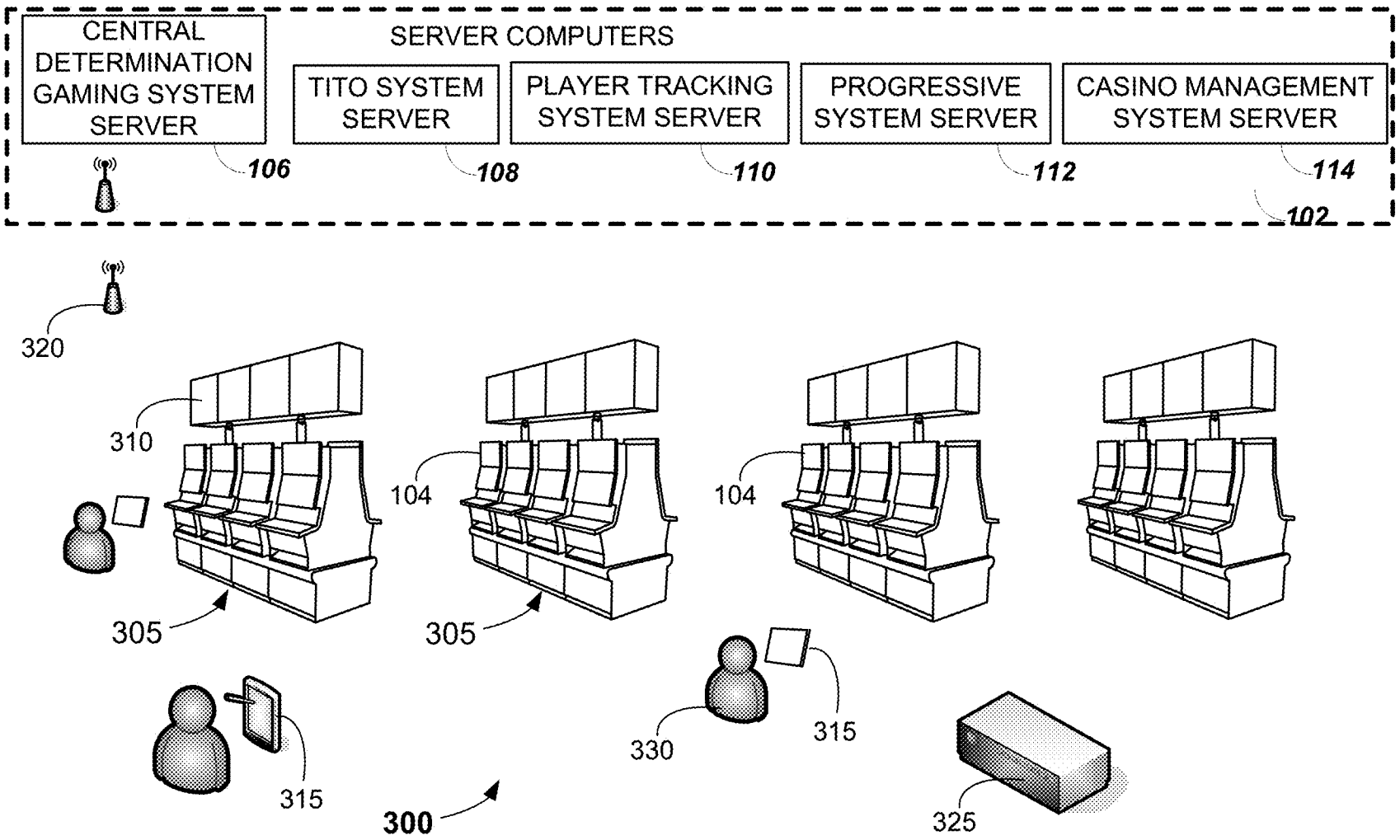
FIG. 3 depicts a casino gaming environment according to one example.

FIG. 3 depicts a casino gaming environment according to one example. In this example, the casino 300 includes banks 305 of EGMs 104. In this example, each bank 305 of EGMs 104 includes a corresponding gaming signage system 310. According to this implementation, the casino 300 also includes mobile gaming devices 315, which are also configured to present wagering games in this example. The mobile gaming devices 315 may, for example, include tablet devices, cellular phones, smart phones and/or other handheld devices. In this example, the mobile gaming devices 315 are configured for communication with one or more other devices in the casino 300, including but not limited to one or more of the server computers 102, via wireless access points 320.

According to some examples, the mobile gaming devices 315 may be configured for stand-alone determination of game outcomes. However, in some alternative implementations the mobile gaming devices 315 may be configured to receive game outcomes from another device, such as the central determination gaming system server 106, one of the EGMs 104, etc.

Some mobile gaming devices 315 may be configured to accept monetary credits from a credit or debit card, via a wireless interface (e.g., via a wireless payment app), via tickets, via a patron casino account, etc. However, some mobile gaming devices 315 may not be configured to accept monetary credits via a credit or debit card. Some mobile gaming devices 315 may include a ticket reader and/or a ticket printer whereas some mobile gaming devices 315 may not, depending on the particular implementation.

In some implementations, the casino 300 may include one or more kiosks 325 that are configured to facilitate monetary transactions involving the mobile gaming devices 315, which may include cash out and/or cash in transactions. The kiosks 325 may be configured for wired and/or wireless communication with the mobile gaming devices 315. The kiosks 325 may be configured to accept monetary credits from casino patrons 330 and/or to dispense monetary credits to casino patrons 330 via cash, a credit or debit card, via a wireless interface (e.g., via a wireless payment app), via tickets, etc. According to some examples, the kiosks 325 may be configured to accept monetary credits from a casino patron and to provide a corresponding amount of monetary credits to a mobile gaming device 315 for wagering purposes, e.g., via a wireless link such as a near-field communications link. In some such examples, when a casino patron 330 is ready to cash out, the casino patron 330 may select a cash out option provided by a mobile gaming device 315, which may include a real button or a virtual button (e.g., a button provided via a graphical user interface) in some instances. In some such examples, the mobile gaming device 315 may send a "cash out" signal to a kiosk 325 via a wireless link in response to receiving a "cash out" indication from a casino patron. The kiosk 325 may provide monetary credits to the patron 330 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 315 and/or a kiosk 325.

Some mobile gaming devices 315 may be configured for receiving and/or transmitting player loyalty information. For example, some mobile gaming devices 315 may be configured for wireless communication with the player tracking system server 110. Some mobile gaming devices 315 may be configured for receiving and/or transmitting player loyalty information via wireless communication with a patron's player loyalty card, a patron's smartphone, etc.

According to some implementations, a mobile gaming device 315 may be configured to provide safeguards that prevent the mobile gaming device 315 from being used by an unauthorized person. For example, some mobile gaming devices 315 may include one or more biometric sensors and may be configured to receive input via the biometric sensor(s) to verify the identity of an authorized patron. Some mobile gaming devices 315 may be configured to function only within a predetermined or configurable area, such as a casino gaming area.

Figure 4:
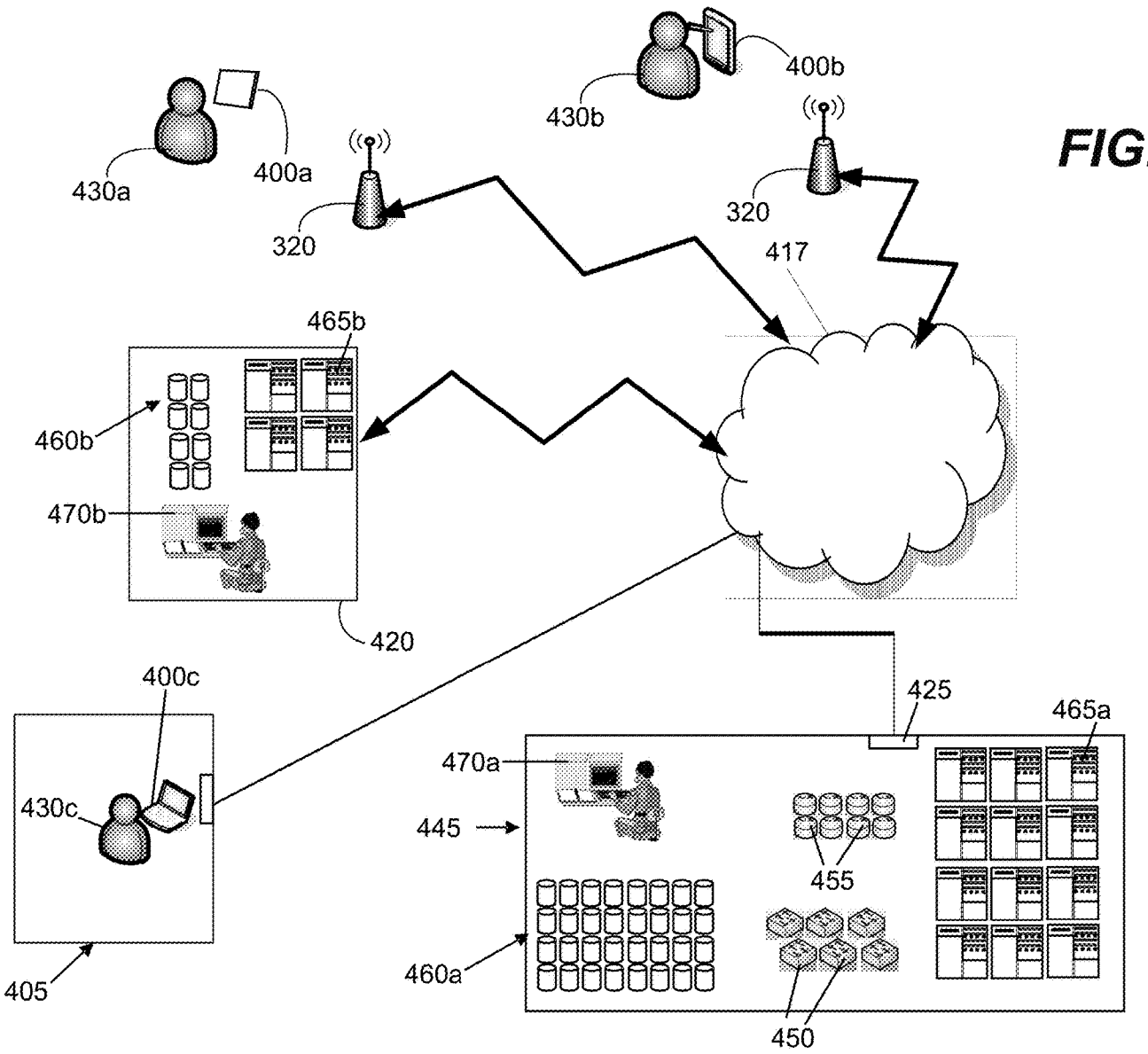
FIG. 4 is a diagram that shows examples of components of a system for providing online gaming according to some aspects of the present disclosure.

FIG. 4 is a diagram that shows examples of components of a system for providing online gaming according to some aspects of the present disclosure. As with other figures presented in this disclosure, the numbers, types and arrangements of devices shown in FIG. 4 are merely shown by way of example. In this example, various devices, including but not limited to end user devices (EUDs) 400*a*, 400*b* and 400*c* are capable of communication via one or more networks 417. The networks 417 may, for example, include one or more cellular telephone networks, the Internet, etc. In this example, the EUDs 400*a* and 400*b* are mobile devices: according to this example the EUD 400*a* is a tablet device and the EUD 400*b* is a smart phone. In this implementation, the EUD 400*c* is a laptop computer that is located within a residence 405 at the time depicted in FIG. 4. Accordingly, in this example the hardware of EUDs is not specifically configured for online gaming, although each EUD is configured with software for online gaming. Other implementations may include other types of EUD, some of which may be specifically configured for online gaming.

In this example, a gaming data center 445 includes various devices that are configured to provide online wagering games via the networks 417. The gaming data center 445 is capable of communication with the networks 417 via the gateway 425. In this example, switches 450 and routers 455 are configured to provide network connectivity for devices of the gaming data center 445, including storage devices 460*a*, servers 465*a* and one or more workstations 570*a*. The servers 465*a* may, for example, be configured to provide access to a library of games for online game play. In some examples, code for executing at least some of the games may initially be stored on one or more of the storage devices 460*a*. The code may be subsequently loaded onto a server 465*a* after selection by a player via an EUD and communication of that selection from the EUD via the networks 417. The server 465*a* onto which code for the selected game has been loaded may provide the game according to selections made by a player and indicated via the player's EUD. In other examples, code for executing at least some of the games may initially be stored on one or more of the servers 465*a*. Although only one gaming data center 445 is shown in FIG. 4, some implementations may include multiple gaming data centers 445.

In this example, a financial institution data center 420 is also configured for communication via the networks 417. Here, the financial institution data center 420 includes servers 465*b*, storage devices 460*b*, and one or more workstations 470*b*. According to this example, the financial institution data center 420 is configured to maintain financial accounts, such as checking accounts, savings accounts, loan accounts, etc. In some implementations one or more of the authorized users 430*a*-430*c* may maintain at least one financial account with the financial institution that is serviced via the financial institution data center 420.

According to some implementations, the gaming data center 445 may be configured to provide online wagering games in which money may be won or lost. According to some such implementations, one or more of the servers 465*a* may be configured to monitor player credit balances, which may be expressed in game credits, in currency units, or in any other appropriate manner. In some implementations, the server(s) 465*a* may be configured to obtain financial credits from and/or provide financial credits to one or more financial institutions, according to a player's "cash in" selections, wagering game results and a player's "cash out" instructions. According to some such implementations, the server(s) 465*a* may be configured to electronically credit or debit the account of a player that is maintained by a financial institution, e.g., an account that is maintained via the financial institution data center 420. The server(s) 465*a* may, in some examples, be configured to maintain an audit record of such transactions.

In some alternative implementations, the gaming data center 445 may be configured to provide online wagering games for which credits may not be exchanged for cash or the equivalent. In some such examples, players may purchase game credits for online game play, but may not "cash out" for monetary credit after a gaming session. Moreover, although the financial institution data center 420 and the gaming data center 445 include their own servers and storage devices in this example, in some examples the financial institution data center 420 and/or the gaming data center 445 may use offsite "cloud-based" servers and/or storage devices. In some alternative examples, the financial institution data center 420 and/or the gaming data center 445 may rely entirely on cloud-based servers.

One or more types of devices in the gaming data center 445 (or elsewhere) may be capable of executing middleware, e.g., for data management and/or device communication. Authentication information, player tracking information, etc., including but not limited to information obtained by EUDs 400 and/or other information regarding authorized users of EUDs 400 (including but not limited to the authorized users 430*a*-430*c*), may be stored on storage devices 460 and/or servers 465. Other game-related information and/or software, such as information and/or software relating to leaderboards, players currently playing a game, game themes, game-related promotions, game competitions, etc., also may be stored on storage devices 460 and/or servers 465. In some implementations, some such game-related software may be available as "apps" and may be downloadable (e.g., from the gaming data center 445) by authorized users.

In some examples, authorized users and/or entities (such as representatives of gaming regulatory authorities) may obtain gaming-related information via the gaming data center 445. One or more other devices (such EUDs 400 or devices of the gaming data center 445) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

Games that involve what may be referred to herein as "WYSIWYG" (what you see is what you get) symbols or "prize on" symbols are popular with some players. "Prize on" symbols may, for example, be presented during instances of a wagering game, such as a slot game. Prize on symbols generally provide an express indication of a prize that may potentially be won. For example, a prize on symbol may indicate a number corresponding to a number of game credits, a currency unit, an award multiplier, a progressive award, etc., that may potentially be won. Alternatively, or additionally, a prize on symbol may indicate text or a picture corresponding to a prize that may potentially be won.

Players like some aspects of existing wagering games that involve prize on symbols. For example, when a prize on symbol lands, a player knows the potential value of the prize on symbol. Moreover, if additional prize on symbols land, the player may feel increased excitement at potentially triggering a feature game, e.g. a bonus game, which may then provide an award of the total of all values of the prize on symbols.

However, some players find other aspects of existing wagering games that involve prize on symbols to be less than optimal. For example, in some existing wagering games, an award of the value of a prize on symbol can only be realized if a feature game is triggered, e.g., if one or more bonus games are triggered.

Particular aspects of the subject matter described in this disclosure can be implemented to realize one or more of the following potential advantages. In some implementations, the value of all prize on symbols that land during a single instance of a base game may be awarded if a prize on trigger symbol, such as a symbol that may be referred to herein as a blast symbol, also lands during the same instance of the base game. According to some such examples, a feature does not need to be triggered during the instance of the base game for the value of all prize on symbols that land during the instance of the base game to be awarded.

According to some implementations, the value of all prize on symbols that land during a single instance of a free game may be awarded if a prize on trigger symbol also lands during the same instance of the free game. Such free game(s), which are examples of "features," may be triggered in various ways depending on the particular implementation. In some examples, one or more free games may be triggered by a combination of scatter symbols. In some implementations, an award of a free game may be triggered by a single blast symbol.

In some instances, the player may also receive an additional benefit if at least a threshold number of prize on symbols and/or one or more other symbols land during an instance of a base game. For example, if at least a threshold number of prize on symbols lands during an instance of a base game, an award of a feature game may be triggered. In some examples, a blast symbol may count as one of the threshold number of symbols. According to some such examples, the feature game may include one or more "hold and spin" bonus games during which the prize on symbols that landed during the instance of the base game are "held" and remain in place during the bonus game(s). If multiple "hold and spin" bonus games are awarded, the prize on symbols that land during an instance of a bonus game may also be "held" and may remain in place during the subsequent bonus game(s).

In some examples, the combined value of all held prize on symbols and all prize on symbols that land during an instance of a bonus game may be awarded if a blast symbol also lands during the same instance of the "hold and spin" bonus game. In some implementations, the value of all accumulated prize on symbols may be paid at the end of the "hold and spin" bonus round, regardless of whether a blast symbol has landed during the "hold and spin" bonus round. In some implementations, if a threshold number of prize on symbols, including but not limited to held prize on symbols, are accumulated during a "hold and spin" bonus round, a jackpot may be awarded.

The above-described features may enhance player excitement. For example, the player may anticipate the possibility of obtaining an immediate additional benefit, above and beyond the other potential awards of a base game, based on the prize on symbols that land during an instance of the base game. The player may hope for such immediate additional benefits even if the award of a feature game is not triggered. However, if the award of a feature game is triggered, the player's excitement may be enhanced by the potential immediate additional benefits that may be obtained based on the prize on symbols that land during instances of free games or "hold and spin" bonus games. The player may benefit from various types of symbols landing, including but not limited to prize on symbols and prize on trigger symbols. Accordingly, the player may be hoping for various types of symbols to land, depending on the other symbols that have landed during a particular instance of a base game, a free game and/or a "hold and spin" bonus round.

Figure 5:
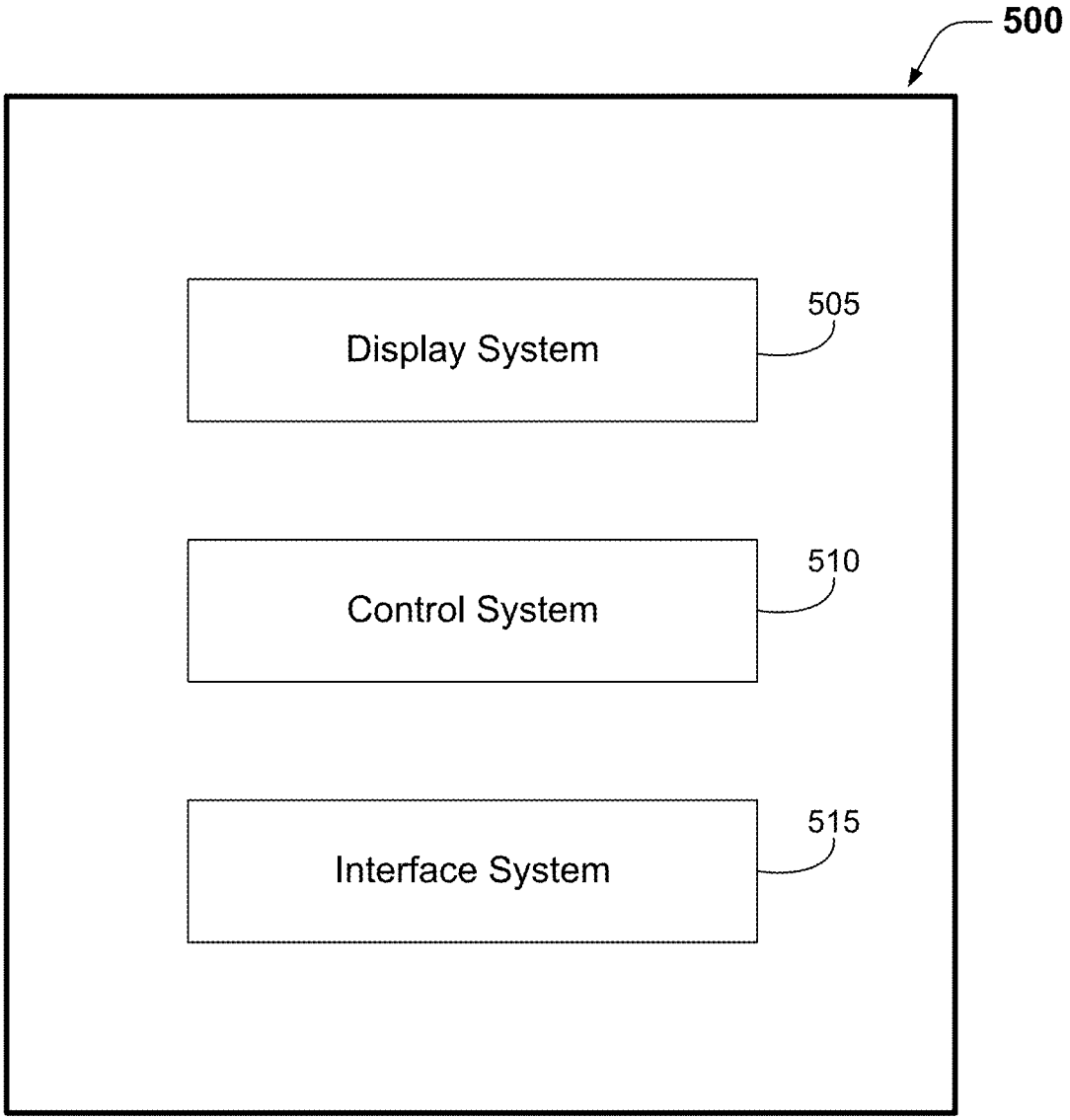
FIG. 5 is a block diagram that shows blocks of an apparatus according to one example.

FIG. 5 is a block diagram that shows blocks of an apparatus according to one example. According to some examples, the apparatus 500 may be an EGM such as those described above with reference to FIGS. 1 and 2. However, in alternative examples, the apparatus 500 may be a mobile device such as described above with reference to FIG. 3 or an EUD as described above with reference to FIG. 4. In this example, the apparatus 500 includes a display system 505 and a control system 510 that is configured to communicate with the display system 505. In this example, the control system 510 is configured to communicate with the display system 505 via wired communication, e.g., via electrical signals. In alternative implementations, the control system 510 may be configured to communicate with the display system 505 via wireless communication. Accordingly, at least a portion of the control system 510 may be coupled to the display system 505. As used herein, the term "coupled to" has a meaning that could include being physically coupled for wired communication or being configured for wireless communication.

The control system 510 may include one or more general purpose single- or multi-chip processors, digital signal processors (DSPs), application specific integrated circuits (ASICs), field programmable gate arrays (FPGAs) or other programmable logic devices, discrete gates or transistor logic, discrete hardware components, or combinations thereof. Although the interface system 515 is shown as being separate from the control system 510, in some implementations the interface system 515 may be part of the control system 510. In some implementations, the interface system 515 may include the entire control system 510. The control system 510 also may include (and/or be configured for communication with) one or more memory devices, such as one or more random access memory (RAM) devices, read-only memory (ROM) devices and/or other types of non-transitory media. In some implementations, at least a portion of the control system 510 may be implemented as a register. Accordingly, the apparatus 500 may have a memory system that includes one or more memory devices, though the memory system is not shown in FIG. 5.

The control system 510 may be capable of performing, at least in part, the methods disclosed herein. In some examples, the control system 510 may be capable of performing at least some of the methods described herein according to instructions (e.g., software) stored on non-transitory media. For example, the control system 510 may be configured for controlling the display system 505 and/or for receiving and processing data from at least a portion of the display system 505, e.g., as described below.

The display system 505 may include, one or more liquid crystal displays (LCDs), plasma displays, light-emitting diode (LED) displays, microLED displays or organic light-emitting diode (OLED) displays. According to some implementations, the display system 505 may include at least one flexible display, such as a flexible OLED. Although shown as separate components in FIG. 5, the display system 505 may, in some examples, include at least a portion of the control system 510. For example, the display system 505 may include one or more processors, microprocessors, programmable logic devices, discrete gates or transistor logic, etc.

In the example shown in FIG. 5, the apparatus 500 includes an interface system 515. In some examples, the interface system may include a wireless interface system. In some implementations, the interface system 515 may include a network interface, an interface between the control system 510 and the display system 505, an interface between the control system 510 and a memory system and/or an interface between the control system 510 and an external device interface (e.g., a port or an applications processor). In some examples, the interface system 515 may include one or more user interfaces, such as a touch screen, one or more buttons, a gesture recognition system, a voice recognition system, etc.

According to some implementations, the apparatus 500 may be a single device, whereas in other implementations the apparatus 500 may be a system that includes more than one device. Accordingly, the terms "apparatus" and "system" may sometimes be used interchangeably herein. In other examples, the apparatus 500 may be a component of another device. For example, in some implementations at least a portion of the display system 505 and/or the control system 510 may be included in more than one apparatus. For example, in some implementations at least part of the control system 510 may reside in a server, such as a central determination server, a server that tracks feature credits, etc.

Figure 6:
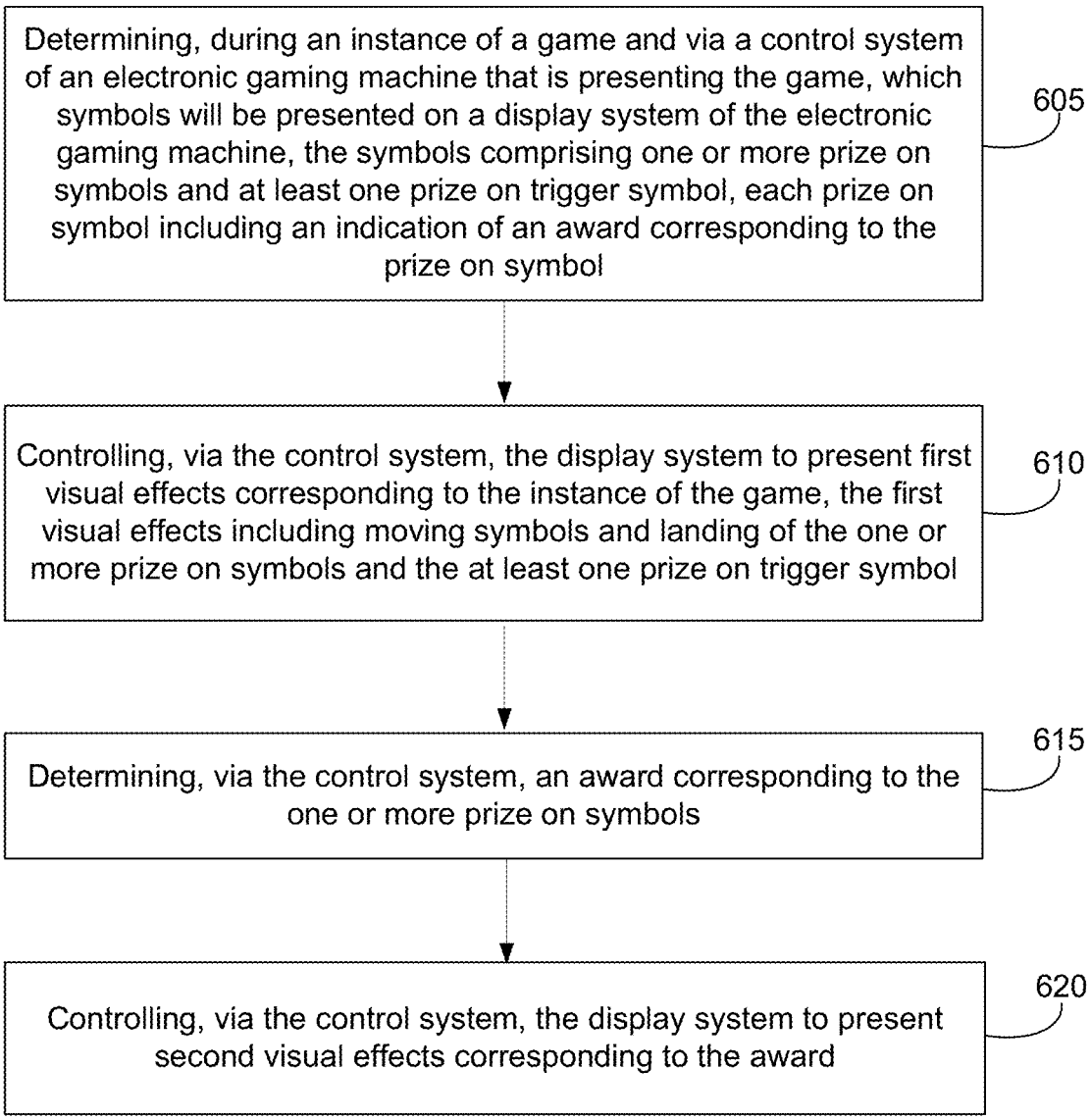
FIG. 6 is a flow diagram that shows blocks of a method according to one example.

FIG. 6 is a flow diagram that shows blocks of a method according to one example. In some examples method 600 may be performed, at least in part, by an apparatus such as that described above with reference to FIG. 5. In some examples, the method 600 may be performed by a control system (e.g., the control system 510 of FIG. 5) according to software stored upon one or more non-transitory storage media. As with other methods described herein, the number and sequence of blocks shown in FIG. 6 are merely examples. In some implementations, for example, block 615 may be performed before block 610 is performed. Similar disclosed methods may include more or fewer blocks. Moreover, at least some of the blocks may occur in a different sequence than the sequence that is shown in a flow diagram.

According to this example, block 605 involves determining, during an instance of a game and via a control system of an electronic gaming machine that that is presenting the game, which symbols will be presented on a display system of the electronic gaming machine. In this example, the symbols include one or more prize on symbols and at least one prize on trigger symbol. Here, each prize on symbol includes an indication of an award corresponding to the prize on symbol. The appearance, type and effect of the prize on symbols and the prize on trigger symbol may vary according to the particular implementation. For example, a prize on symbol may indicate a number corresponding to a number of game credits, a currency unit, an award multiplier, a progressive award, etc., that may potentially be won. According to some examples, a prize on symbol may indicate a particular bonus or progressive bonus award, such as a Mini Bonus, Minor Bonus or Major Jackpot, etc., that may potentially be won. In some examples, the prize on trigger symbol may be a "blast" symbol, such as a Lightning Blast™ symbol. Various examples of prize on trigger symbols are illustrated in FIGS. 7-9, 13, 14 and 17-19, and are described below.

In some examples, the game may be a base game. In other examples, the game may be a free spin bonus game. In some instances, the game may be a feature game, such as a "hold and spin" bonus game.

According to some such examples, a feature game may not be triggered solely by the landing of a prize on trigger symbol during a base game. In some such examples, one or more other types of symbols, such as a scatter pay symbol, may trigger a feature game. However, in some instances, if a prize on trigger symbol lands during a base game, this may trigger a feature game and trigger an award that corresponds with the prize on symbols. Some such examples are described below in the context of "hold and spin" features.

In this implementation, block 610 involves controlling, via the control system, the display system to present first visual effects corresponding to the instance of the game. According to this example, the first visual effects include moving symbols and landing of one or more prize on symbols and at least one prize on trigger symbol.

According to this example, block 615 involves determining, via the control system, an award corresponding to the one or more prize on symbols. In some instances, block 615 may involve adding the value(s) indicated by the prize on symbol(s) to determine the award. Alternatively, or additionally, block 615 may involve applying an award multiplier indicated by a prize on symbol. In some examples, a prize on symbol may indicate a particular bonus or progressive bonus award, such as a Mini Bonus, Minor Bonus or Major Jackpot, etc. According to some such examples, block 615 may involve determining the current value of the progressive bonus award indicated by the prize on symbol.

In some implementations, block 615 may be performed before block 610 is performed. For example, the determinations of blocks 605 and those of 615 may all take place before the display system presents first visual effects corresponding to the instance of the game.

In the example shown in FIG. 6, block 620 involves controlling, via the control system, the display system to present second visual effects corresponding to the award. For example, block 620 may involve controlling an image of a credit meter and/or a "total win" meter shown in the display system to increment its value in an amount corresponding to the award. In some implementations, block 620 may involve controlling the display system to display effects corresponding to the award, such as a shower of coin images and/or currency note images. According to some examples, block 620 may involve controlling an audio system of the gaming machine to provide sounds corresponding to the award, such as sounds corresponding to a shower of coins.

Figure 7:
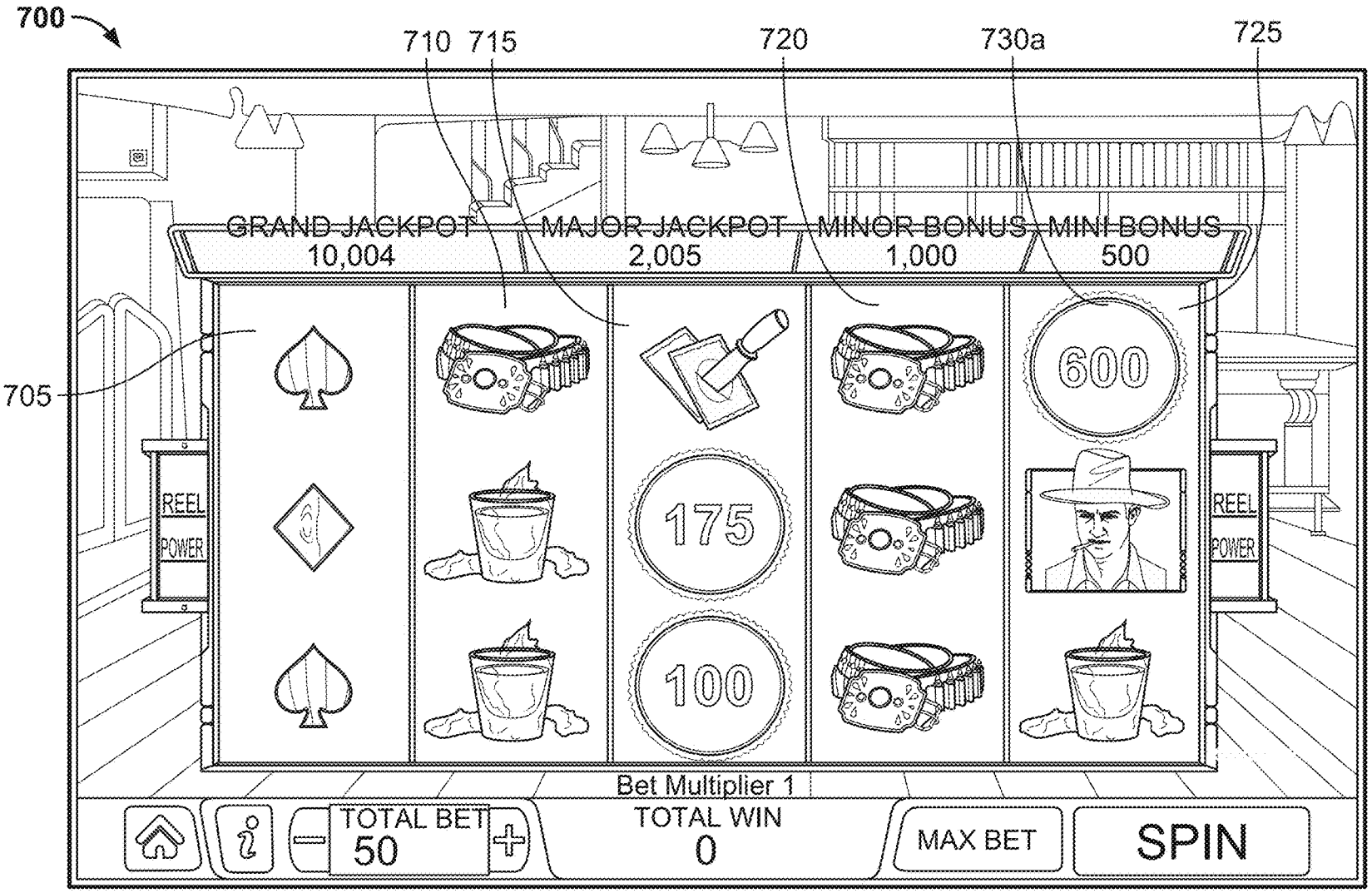
FIG. 7 shows examples of prize on symbols that may be displayed during an instance of a game.

FIG. 7 shows examples of prize on symbols that may be displayed during an instance of a game. According to this example, the image 700 was captured after all symbols had landed during an instance of a game. In this example, the game is a slot game in which reels 705-725 each show three symbols that have landed during an instance of a base game. In some examples, each of the fifteen symbol areas may function as a reel, such that there are effectively fifteen reels instead of five reels.

In the example shown in FIG. 7, reel 715 includes two prize on symbols and reel 725 includes one prize on symbol. In this instance, each of the prize on symbols indicates a game credit value, which also may correspond with a currency value in some implementations. For example, the prize on symbol 730*a* indicates a prize of 600 game credits. According to this example, no prize on trigger symbol landed during this instance of the game, so the value of the prize on symbols was not awarded.

Figure 8:
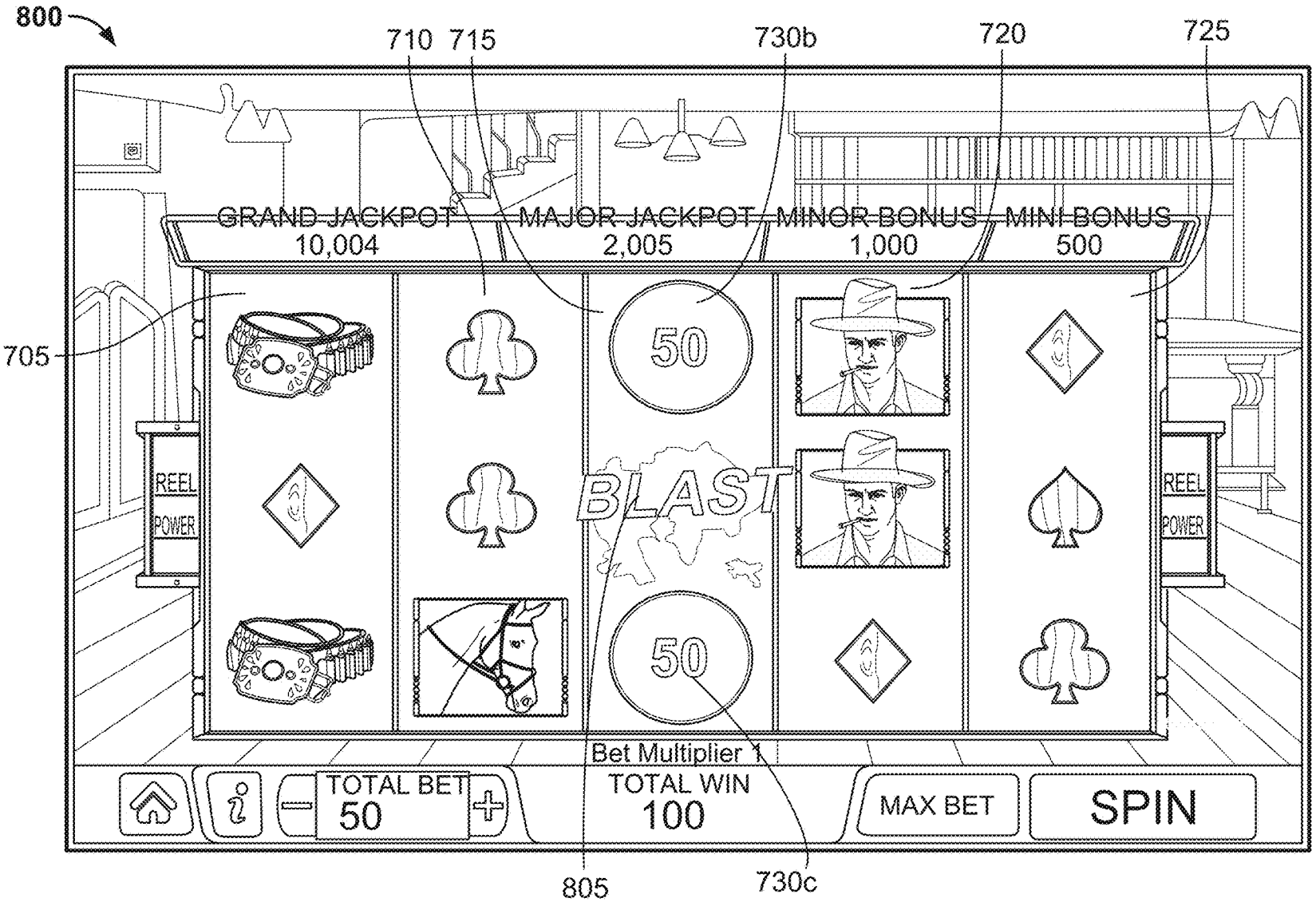
FIG. 8 shows examples of prize on symbols and a prize on trigger symbol that have landed during an instance of a game.

FIG. 8 shows examples of prize on symbols and a prize on trigger symbol that have landed during an instance of a game. In this instance, each of the prize on symbols indicates a game credit value: here, the prize on symbol 730*b* and the prize on symbol 730*c* both indicate a prize of 50 game credits. In this example, the prize on trigger symbol 805 is one example of what will be referred to herein as a "blast symbol."

In this example, the image 800 was captured after all symbols had dropped during an instance of a game and at a time during which the blast symbol is in the process of a simulated explosion. According to this example, because the prize on symbols 730*b* and 730*c*, as well as the prize on trigger symbol 805, landed during this instance of the game, the value of the prize on symbols 730*b* and 730*c* was awarded. A 100-credit award corresponding to the value of the prize on symbols 730*b* and 730*c* is shown via the "total win" meter 810. Accordingly, the image 800 may be considered an example of block 620, in which a display system is presenting "second visual effects" corresponding to the award.

Various symbols, or combinations of symbols, may trigger a feature, according to the particular implementation. According to some examples, a feature that includes one or more free games may be triggered by a particular symbol, such as a scatter pay symbol.

Some features may provide one or more "hold and spin" games. According to some examples, the prize on symbols that have already landed when a "hold and spin" game begins will be displayed as if locked into position while other slot reel portions will present images of moving symbols until a symbol lands. According to some implementations, a "hold and spin" game (or another example of a feature) may be triggered when at least a threshold number of prize on symbols lands during a base game.

For example, during an instance of a base game, a control system may determine that at least T prize on symbols will land. In this example, T corresponds to a threshold number of prize on symbols required to trigger a feature. In some examples T may be 6, whereas in other examples T may be an integer that is larger or smaller than 6, such as 4, 5, 7, 8, etc. According to some such examples, the feature may include one or more "hold and spin" bonus games. If the control system determines that at least one prize on trigger symbol will land during the instance of the base game, the control system may also determine an award corresponding to the at least T prize on symbols that landed during the instance of the base game. The control system may be configured to control a display system of a gaming machine to present the feature after controlling the display system to present second visual effects corresponding to the award.

In some implementations, the threshold number required to trigger a feature may include some combination of prize on symbols and one or more other symbols, such as a prize on trigger symbol. For example, a control system may determine, during an instance of a base game, that (T−1) prize on symbols will land. In this example, (T−1) corresponds to a number that is one less than a threshold number of prize on symbols required to trigger a feature. The feature may, for example, include one or more "hold and spin" bonus games. According to some implementations, if the control system determines, during the same instance of the base game, that at least one prize on trigger symbol lands, the control system may determine that the feature will be triggered.

In addition, the control system may determine that an award corresponding to the (T−1) prize on symbols will be awarded. In some such implementations, the award will be made prior to the feature game(s). For example, the control system may control a display system to present the feature after controlling the display system to present second visual effects corresponding to the award.

Figure 9:
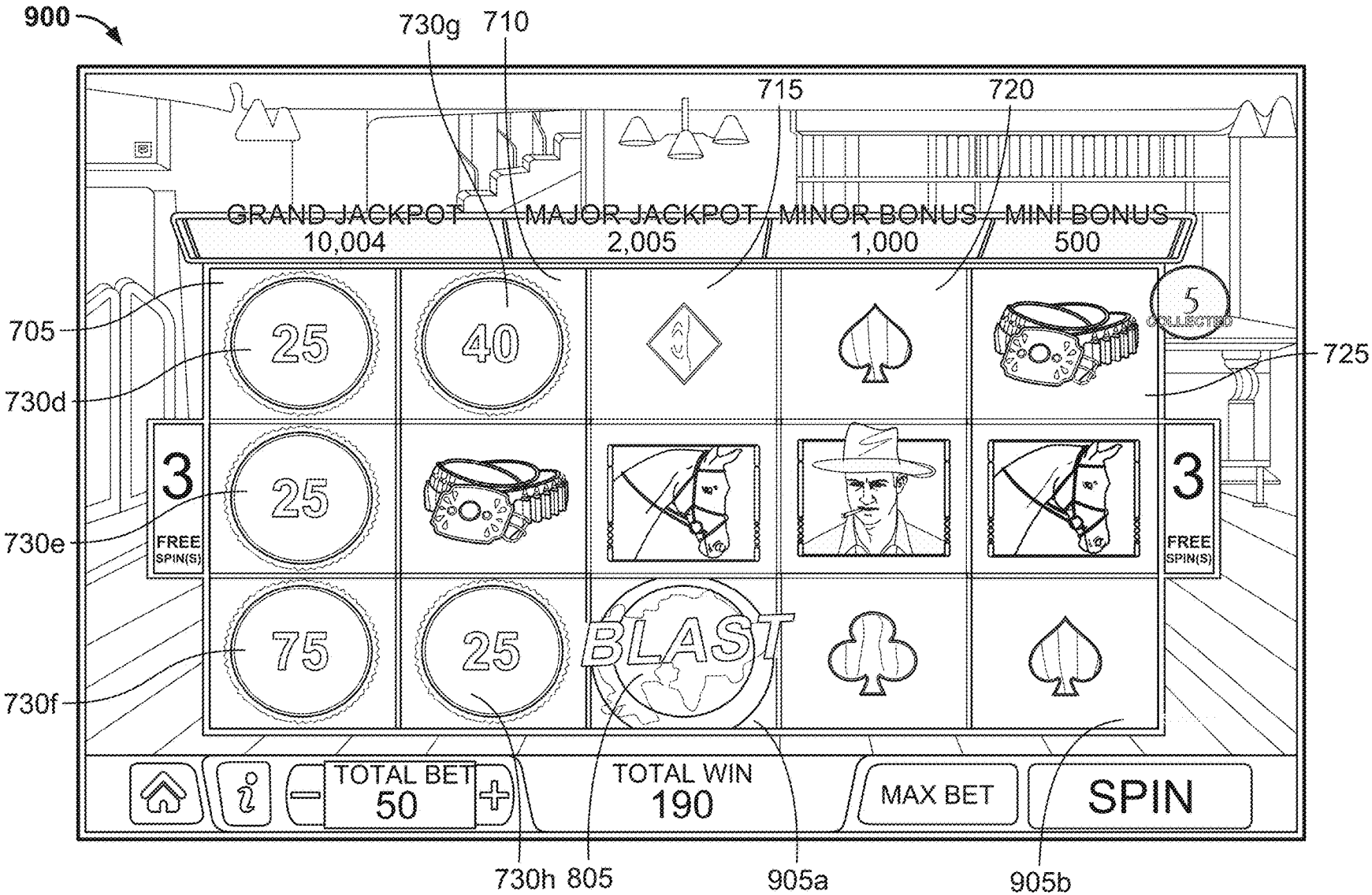
FIG. 9 shows an example of a base game outcome in which a prize on trigger symbol lands during an instance of a base game in which a feature is triggered.

Accordingly, in some examples a control system (such as the control system 510 that is described above with reference to FIG. 5) may determine that a prize on trigger symbol lands during an instance of a base game in which a feature is triggered. FIG. 9 shows an example of a base game outcome in which a prize on trigger symbol lands during an instance of a base game in which a feature is triggered. According to this example, the threshold number T (of prize on symbols required to trigger a feature) is six. In this example, the control system has determined that (T−1), which in this instance equals five prize on symbols, land during the instance of the base game: here, prize on symbols **730*d*-730*h* land during the instance of the base game. In this example, the control system has determined that a prize on trigger symbol (the prize on trigger symbol 805, which is a blast symbol in this example) lands during the instance of the base game and that a combination of the prize on trigger symbol and the (T−1) prize on symbols will trigger the feature. According to this example, the total win for this instance of the base game equals 190, which is the total value of the prize on symbols shown in the presentation 900**.

However, in other instances, the control system may determine that at least T prize on symbols land during an instance of a base game, where T corresponds to a threshold number of prize on symbols required to trigger a feature. According to some such examples, the control system may determine that a prize on trigger symbol lands during the instance of the base game.

According to some implementations, the type of feature that is triggered when the prize on trigger symbol lands during the instance of the base game in which the feature is triggered may be an enhanced version of the feature that would be triggered by a game outcome in which no prize on trigger symbol lands. The enhanced version of the feature may, for example, include one or more additional bonus games, one or more additional feature instances (each of which may include one or more bonus games) and/or one or more jackpot upgrades (e.g., mini to major, etc.).

According to some examples, the enhanced version of the feature may provide an increased value of one or more prize on symbols. In some such examples, the lowest-value prize on symbol may be removed from a set of possible prize on symbol values. In one such example, if the lowest-value prize on symbol indicated a value of 25 credits, the 25-credit prize on symbol would be removed from the set of possible prize on symbol values available for one or more bonus games of the feature. In some examples, the lowest-value prize on symbols that are removed are replaced with other, higher-value, prize on symbols. According to some examples, the values of all prize on symbols that land, along with the prize on trigger symbol, during a base game instance that triggers a feature, will be upgraded to the next-higher level. For example, if the prize on symbol values increment from 25 credits to 40 credits to 60 credits to 75 credits to 100 credits, the value of a 40-credit prize on symbol that landed during the base game instance that triggers the feature may be upgraded to 60.

According to some implementations, the type of feature that is triggered when the prize on trigger symbol lands during the instance of the base game in which the feature is triggered may be, or may include, a different version of the feature that would be triggered by a game outcome in which no prize on trigger symbol lands. The different version of the feature may, for example, include a different type of bonus game than would otherwise be provided during a feature presentation. If, for example, a feature that would be triggered by a game outcome wherein no prize on trigger symbol lands would include one or more "hold and spin" bonus games, the type of feature that is triggered when the prize on trigger symbol lands during the instance of the base game in which the feature is triggered may be, or may include, one or more other types of bonus games, such as a wheel game, a poker game, a blackjack game, a game of skill, a slot game having a different game theme, a "pick three" game, (e.g., where a player selects, from a choice of a plurality of displayed symbols with hidden prize values, three symbols for revealing of each symbols' hidden prize, the selected symbols' revealed hidden prizes then awarded to the player), etc.

In some examples wherein the feature includes one or more "hold and spin" bonus games, the control system may be configured for controlling the display system to display the prize on symbols and the prize on trigger symbol of the base game in fixed positions during presentation of at least one of the one or more "hold and spin" bonus games. For example, referring to FIG. 9, in some instances the feature that is triggered may include one or more "hold and spin" bonus games. In some such examples, the control system may be configured for controlling the display system to display the prize on symbols **730*d*-730*h* and the prize on trigger symbol 805** of the base game in fixed positions during presentation of at least one of the one or more "hold and spin" bonus games.

According to some such examples, the control system may be configured for determining a bonus game award that includes a combined value of some or all of the one or more prize on symbols that are displayed during an outcome of each "hold and spin" bonus game during which the prize on trigger symbol of the base game is displayed in the fixed position. In one such example, the control system may be configured for controlling the display system to display the prize on symbols 730*d*-730*h* and the prize on trigger symbol 805 of the base game in fixed positions during the presentation of at least the first "hold and spin" bonus game after the base game outcome shown in FIG. 9. If another 40-credit prize on symbol were to land during the first "hold and spin" bonus game, the control system may be configured for determining a bonus game award of 230 credits, which would be the combined value of all of the prize on symbols displayed during the outcome of the first "hold and spin" bonus game.

According to some such implementations, the control system may be configured for controlling the display system to display the prize on trigger symbol and the prize on symbols displayed during the outcome of the base game in fixed positions during presentation of each of the one or more "hold and spin" bonus games. In some such examples, the control system may be configured for determining a bonus game award that includes a combined value of all of the one or more prize on symbols that are displayed during the outcome of each individual "hold and spin" bonus game during which the prize on trigger symbol of the base game is displayed in the fixed position. In some such implementations, the control system may be configured for providing the bonus game award during, or immediately after, a presentation time for the outcome of each individual "hold and spin" bonus game during which the prize on trigger symbol of the base game is displayed in the fixed position. In other words, in such examples the bonus game award will be provided at, or immediately after, the conclusion of each such bonus game.

However, according to some examples, the control system may be configured for determining an accumulated value that is the total of the combined values for all "hold and spin" bonus games during which the prize on trigger symbol is displayed in the fixed position. In some such examples, the control system may be configured for awarding at least the accumulated value if, by a conclusion of all "hold and spin" bonus games, each symbol position of a bonus game symbol matrix displays either a prize on symbol or a prize on trigger symbol. In other words, according to some such examples, the accumulated value will be awarded only if, by the end of all "hold and spin" bonus games of a feature presentation, each symbol position of a bonus game symbol matrix displays either a prize on symbol or a prize on trigger symbol.

However, in alternative implementations, the control system may be configured for controlling the display system to display the prize on trigger symbol of the base game in a fixed position during presentation of F "hold and spin" bonus games, F being a number that is fewer than all of the one or more "hold and spin" bonus games. In some such examples, a "countdown meter" may be displayed, indicating the number of remaining bonus games in which the prize on trigger symbol will be held in the fixed position. According to some examples, the control system may be configured for controlling the display system to replace the prize on trigger symbol of the base game with another prize on symbol or with a prize-enhancing symbol after presentation of the F "hold and spin" bonus games.

In still other implementations, the control system may be configured for controlling the display system to replace the prize on trigger symbol of the base game with another prize on symbol or with a prize-enhancing symbol after the conclusion of the base game, e.g., before the first bonus game of the feature or during the first bonus game of the feature. According to some implementations, the control system may be configured for controlling the display system to display the prize on symbols of the base game and a replacement symbol for the prize on trigger symbol of the base game in fixed positions during presentation at least one (and, in some examples, all) of the one or more "hold and spin" bonus games.

Figure 10:
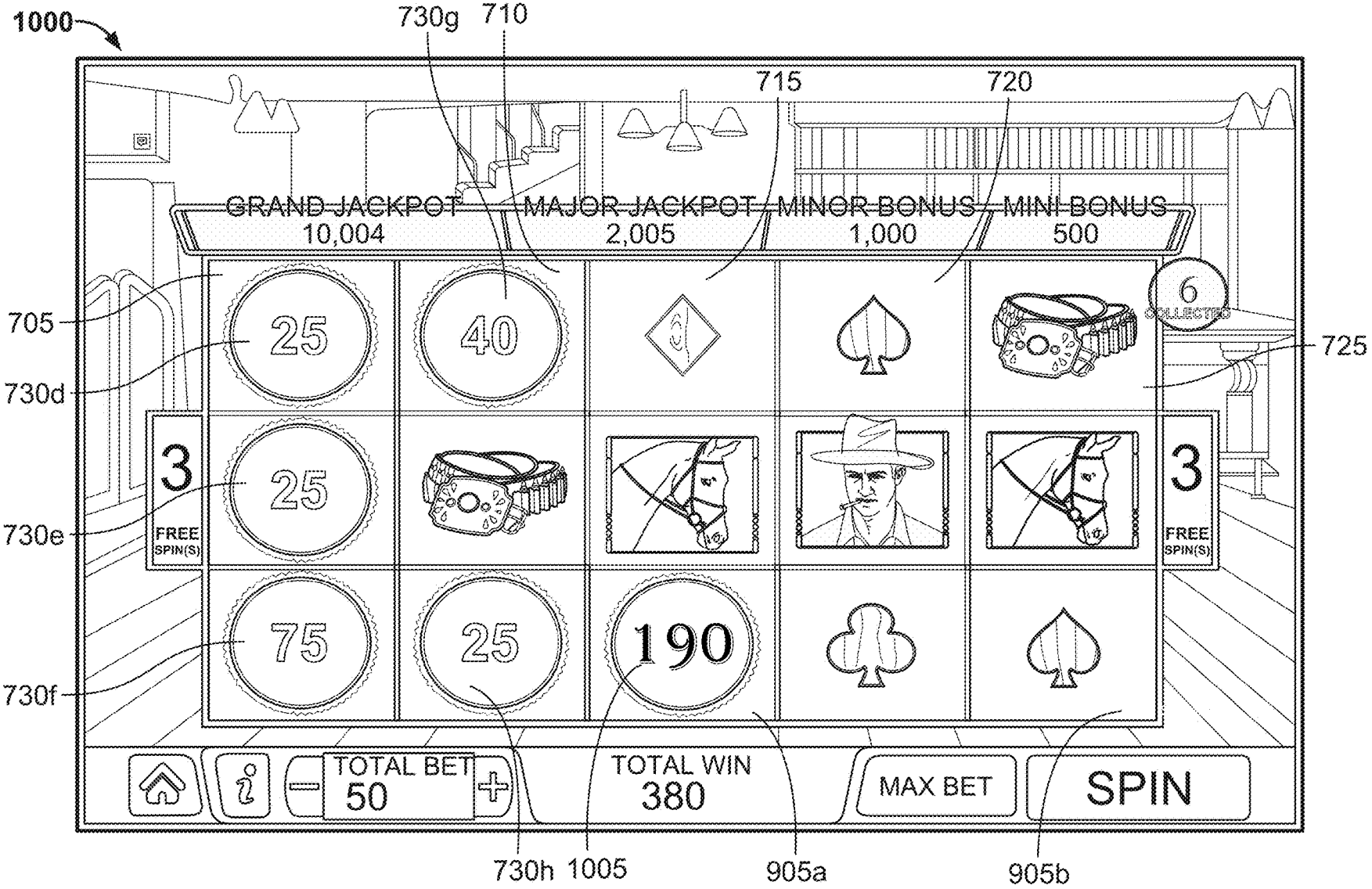
FIG. 10 shows an example in which a prize on trigger symbol of a base game is replaced by a prize on symbol.

FIG. 10 shows an example in which a prize on trigger symbol of a base game is replaced by a prize on symbol. FIG. 10 shows an example of a presentation 1000 that may be presented on a display after the presentation 900 of FIG. 9. In this example, the prize on trigger symbol 805 shown in FIG. 9 has been replaced by the replacement prize on symbol 1005. In this instance, the value of the replacement prize on symbol 1005 is 190 credits, which is the total value of the prize on symbols 730*d*-730*h*. As a result, the total win has increased to 380 credits.

Other implementations may determine the value of the replacement prize on symbol 1005 in different ways. In some such alternative examples, the value of the replacement prize on symbol 1005 may be set to the highest available prize on symbol value. For example, if the highest available prize on symbol value were 600 credits, in some implementations the value of the replacement prize on symbol 1005 may be set to 600 credits. In other implementations, the value of the replacement prize on symbol 1005 may be set to a multiple of what would normally be the highest available prize on symbol value (e.g., the highest available prize on symbol value of the base game or the highest value of a prize on symbol that could land during a feature game). For example, if the highest available prize on symbol value were 600 credits, in some implementations the value of the replacement prize on symbol 1005 may be set to 1200 credits, 1800 credits, 2400 credits, etc. In some implementations, the value of the replacement prize on symbol 1005 may be set to the highest prize on symbol value current shown on the display at the time of replacement of the prize on trigger symbol. For example, FIG. 10 presentation 1000 prize on symbol 730*f* contains the highest prize on symbol value of 75 credits. In this example replacement prize on symbol 1005 is set to 75 credits.

Figure 11:
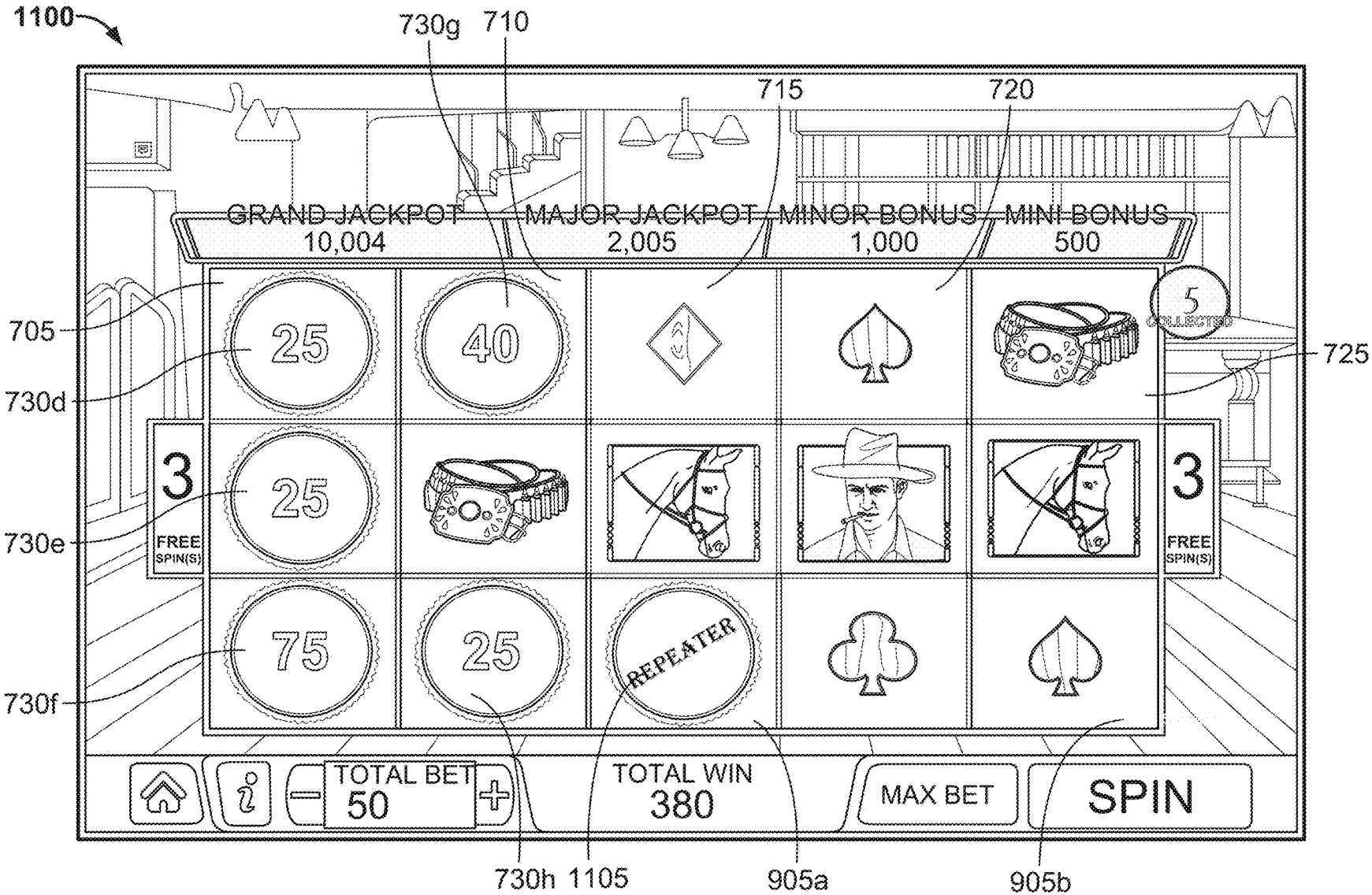
FIG. 11 shows an example in which a prize on trigger symbol of a base game is replaced by a repeater symbol.

FIG. 11 shows an example in which a prize on trigger symbol of a base game is replaced by a repeater symbol. FIG. 11 shows an example of a presentation 1100 that may be presented on a display after the presentation 900 of FIG. 9. In this example, the prize on trigger symbol 805 shown in FIG. 9 has been replaced by the repeater prize on symbol 1105. In this instance, the value of the repeater prize on symbol 1105 is 190 credits, which is the total value of the prize on symbols 730*d*-730*h*. As a result, the total win has increased to 380 credits. In some such implementations, the value of the repeater prize on symbol 1105 will continue to be 190 credits for each "hold and spin" bonus game in which the repeater prize on symbol 1105 is "held" or presented during a bonus game instance. In other implementations, the value of the repeater prize on symbol 1105 will be the total of all prize on symbol credits for each "hold and spin" bonus game outcome during which the repeater prize on symbol

1105 is "held" or presented. In still other implementations, the value of the repeater prize on symbol 1105 will be the highest credit value of all prize on symbols shown in each "hold and spin" bonus game outcome during which the repeater prize on symbol 1105 is "held" or presented.

Figure 12:
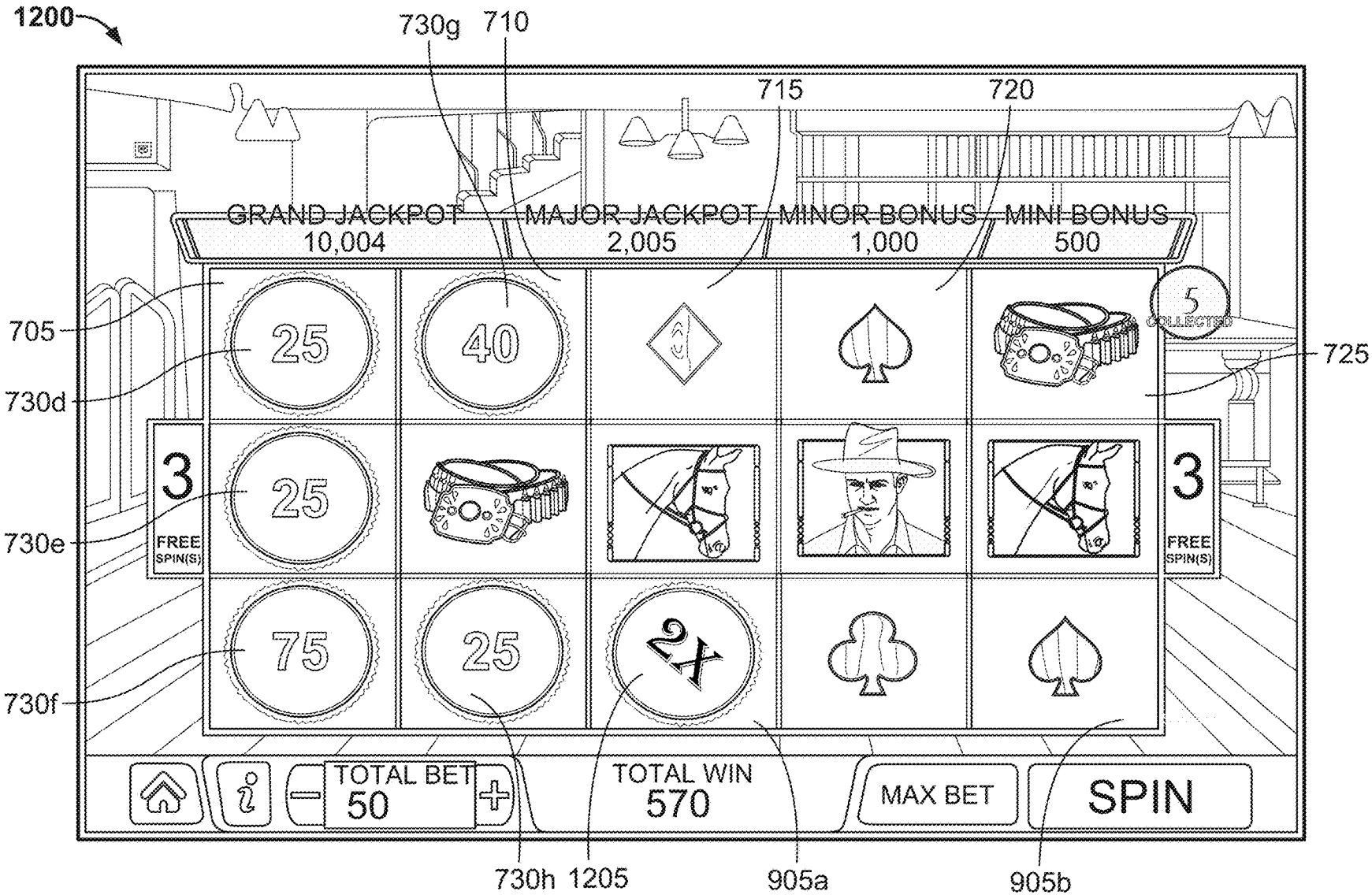
FIG. 12 shows an example in which a prize on trigger symbol of a base game is replaced by a multiplier symbol.

FIG. 12 shows an example in which a prize on trigger symbol of a base game is replaced by a multiplier symbol. FIG. 12 shows an example of a presentation 1200 that may be presented on a display after the presentation 900 of FIG. 9. In this example, the prize on trigger symbol 805 shown in FIG. 9 has been replaced by the multiplier symbol 1205. In this instance, the multiplier symbol 1205 is a "2×" multiplier. According to this example, at the completion of the "hold and spin" bonus game feature the total win will be the sum of all held prize on symbols values times the multiplier value of the multiplier symbol 1205. In this instance, e.g., if no additional prize on symbols drop during the "hold and spin" feature game, the total win value is 380 credits. According to another example, the value of the multiplier prize on symbol 1205 is 380 credits, which is two times the total value of the prize on symbols 730*d*-730*h*. As a result, the total win has increased to 570 credits. In some such implementations, the value of the multiplier prize on symbol 1205 will continue to be 380 credits for each "hold and spin" bonus game in which the multiplier prize on symbol 1205 is "held" or presented during a bonus game instance. In other implementations, the value of the multiplier prize on symbol 1205 will be the multiplier value (in this example, two) times the total of all prize on symbol credits for each "hold and spin" bonus game outcome during which the multiplier prize on symbol 1205 is "held" or presented.

Other implementations may provide multiplier values other than 2×. According to some examples, the multiplier value may be randomly determined before, or during, the first bonus game. In some implementations, the multiplier value may be fixed for all bonus games. In alternative implementations, the multiplier value may be determined (e.g., randomly determined) for each bonus game.

Figure 13:
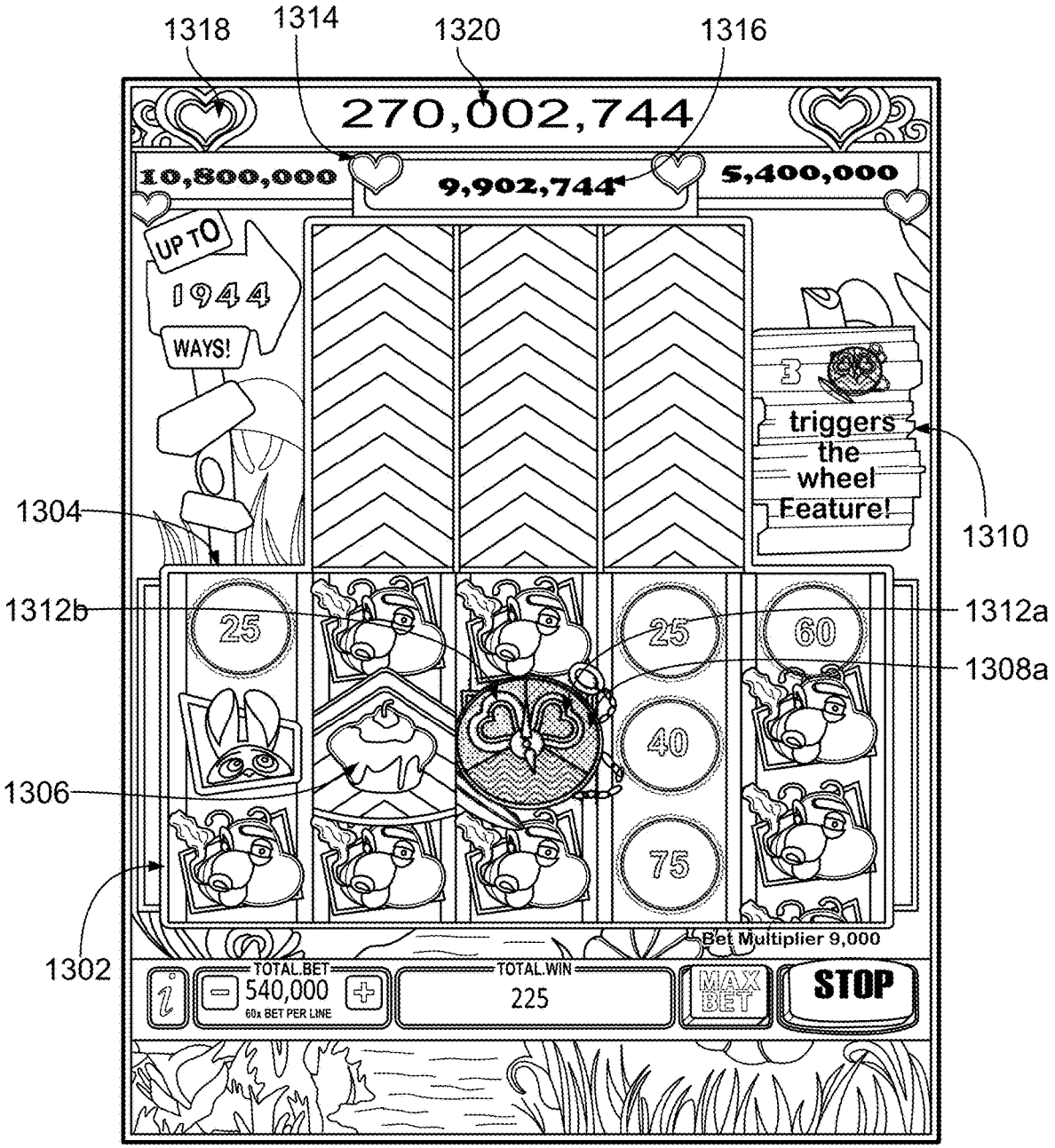
FIG. 13 shows an example of a display that may be presented according to another disclosed implementation.

FIG. 13 shows an example of a display that may be presented according to another disclosed implementation. As with other implementations provided herein, the particular types of elements and the particular arrangement of elements shown in FIG. 13 are merely examples. In this implementation, the game has an "Alice in Wonderland" theme. In this example, at the moment at which the display of FIG. 13 is being presented, the active display symbol positions include three active display symbol rows 1302 and five active display symbol columns 1304.

In this instance, a display system is being controlled to display selected display symbols for a slot game outcome at a plurality of active display symbol positions. According to this implementation, the threshold number of prize on symbols required to trigger a feature is six, unless a prize on trigger symbol lands during the same instance of the base game. In this example, the control system has determined that ((T−1)=five) prize on symbols would land during this instance of a base game, wherein (T−1) corresponds to a number that is one less than a threshold number of prize on symbols required to trigger a feature. According to this example, the control system has determined that the prize on trigger symbol 1306 will also land during the same instance of the base game and that the trigger symbol 1306, in combination with the (T−1) prize on symbols, will trigger a feature that includes one or more "hold and spin" bonus games. In this example, the prize on trigger symbol 1306 results in an award of 225 credits, which is the total value of all 5 prize on symbols that landed during this instance of the base game.

In this instance, the trigger symbol 1306 is an expansion prize on trigger symbol, which also results in increasing a bonus game symbol matrix size for at least one of the one or more "hold and spin" bonus games. According to this example, the expansion prize on trigger symbol 1306 is a cupcake symbol. In some instances, the expansion prize on trigger symbol 1306 may include the words "Eat Me," which correspond to the Alice in Wonderland theme. However, in other implementations the expansion prize on trigger symbol may be a blast symbol or another type of symbol.

FIG. 13 also shows an example of a wheel feature trigger symbol 1308*a*, which is a pocket watch symbol in this example. In some implementations, the wheel feature trigger symbol 1308*a* may be a "scatter pay" symbol. As shown in banner 1310, in this implementation landing at least three wheel feature trigger symbols triggers another type of feature presentation, which includes a wheel feature in this example. According to this example, the wheel feature trigger symbol 1308*a* is an open pocket watch having three internal segments. In this instance, two of the segments include heart images that correspond with the heart images of available jackpots: heart image 1312*a* of the wheel feature trigger symbol 1308*a* corresponds with heart image 1314 and jackpot 1316, which may be a progressive jackpot, and whereas heart image 1312*b* corresponds with heart image 1318 and jackpot 1320, which also may be a progressive jackpot. In this implementation, the presence or absence of these heart images indicates whether a sufficiently high wager has been made to "unlock," or make available, the corresponding jackpots.

Figure 14:
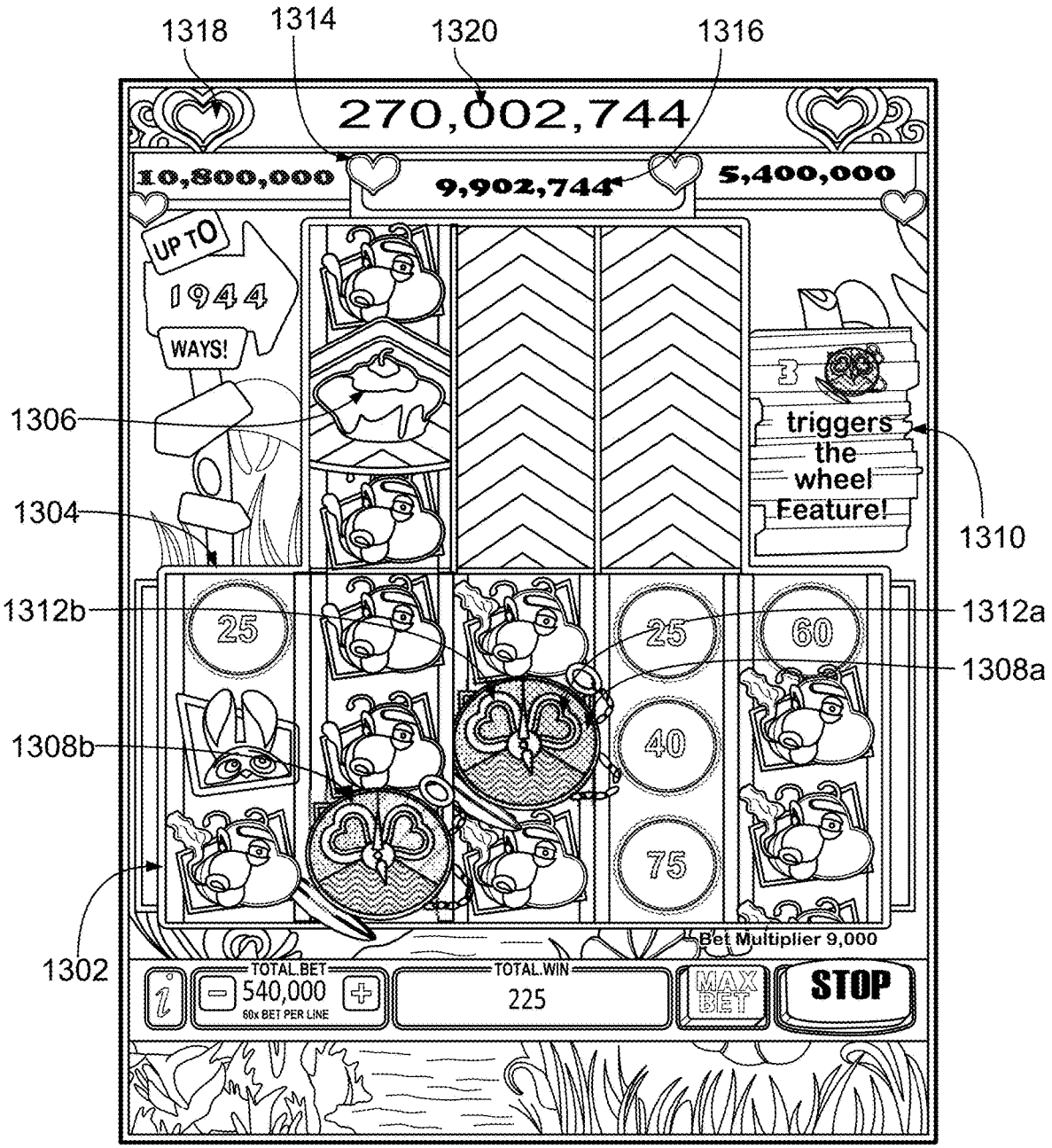
FIG. 14 shows an example of a display that may be presented after the display of FIG. 13.

FIG. 14 shows an example of a display that may be presented after the display of FIG. 13. In this example, a display system has been controlled to present three additional active display symbol positions in a display symbol column in which the expansion prize on trigger symbol 1306 is displayed. Accordingly, the reel on which the expansion prize on trigger symbol 1306 is displayed now includes three additional selected display symbols, one of which is the wheel feature trigger symbol 1308*b*. Having these additional selected display symbols in play, there may be additional ways to win the game. In some implementations, the three additional active display symbol positions will continue to be active for at least one (and in some instances all) bonus games of a feature game round. According to some such implementations, the additional active display symbol positions are additional positions in which a prize on symbol, a prize on trigger symbol, a wheel feature trigger symbol or other potentially advantageous symbols may land during one or more bonus games.

In alternative implementations, the landing of the expansion prize on trigger symbol 1306 in a base game, in combination with the landing of at least (T−1) prize on symbols, may cause other and/or additional active display symbol positions to be available for one or more subsequent bonus games. In some such examples, additional active display symbol positions in one or more additional display symbol columns and/or one or more additional display symbol rows may be available for one or more subsequent bonus games.

FIG. 14 provides an indication that a third wheel feature trigger symbol could, in some instances, be presented among the additional selected display symbols that are presented subsequent to the presentation of an expansion prize on trigger symbol. In this example, only two wheel feature trigger symbols are displayed and therefore the feature is not triggered. As noted in banner 610, in this implementation wild symbols do not apply to wheel feature trigger symbols.

Figure 15:
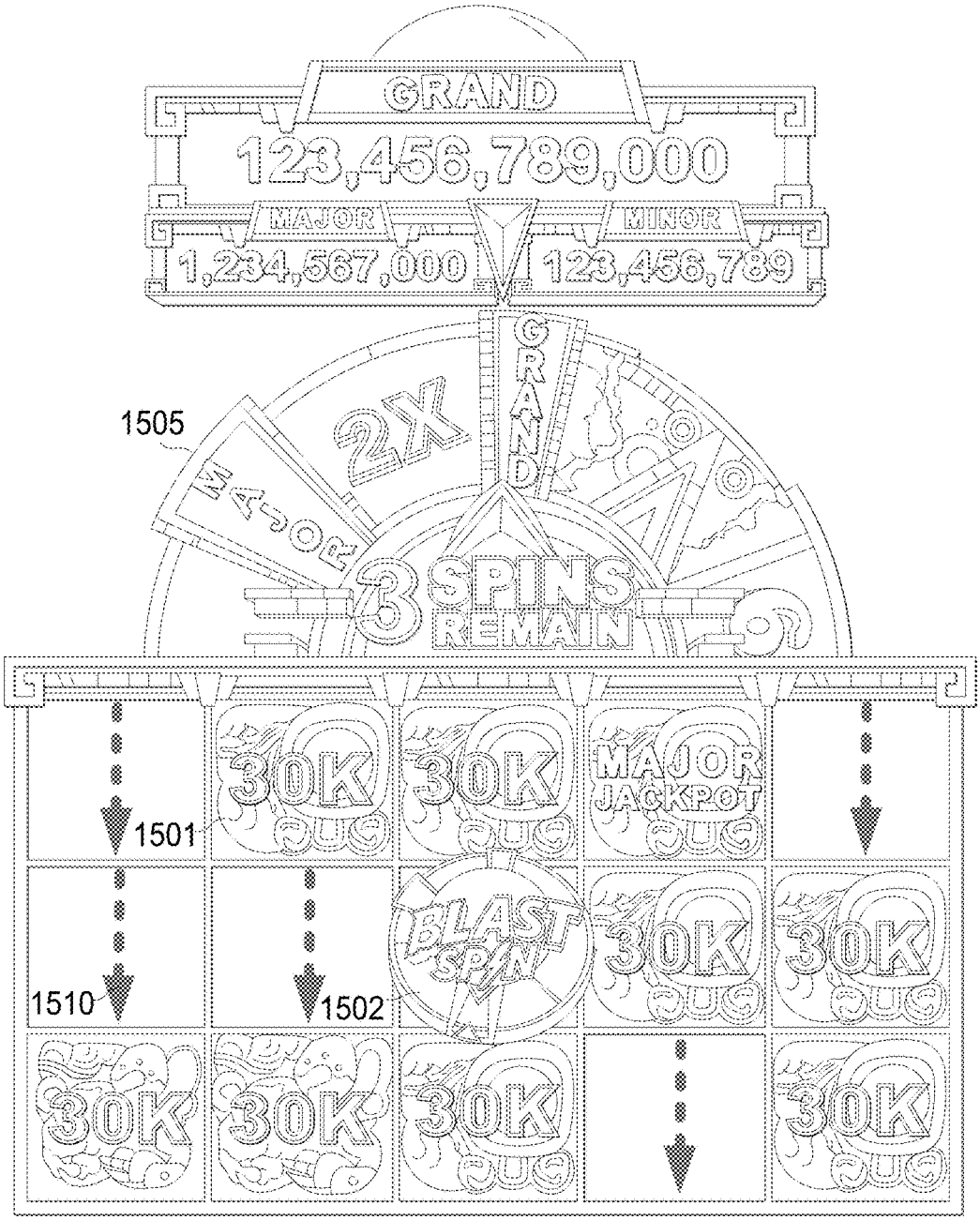
FIG. 15 shows an example of a wheel feature presentation.

FIG. 15 shows an example of a wheel feature presentation. In this example, the wheel feature presentation of FIG. 15 was triggered by a combination of at least (T−1) prize on symbols 1501 (where T is a triggering number of prize on symbols 1501 if no prize on trigger symbol lands) and the prize on trigger symbol 1502, all of which had previously landed during a base game. In alternative examples, the wheel feature presentation of FIG. 15 may have been triggered by a triggering number (T), e.g., three, of wheel feature trigger symbols that had previously landed during a base game. In yet another example, the landing of a prize on trigger symbol, e.g., expansion prize on trigger symbol 1306, in combination with the landing of at least two (T−1) wheel feature trigger symbols may have triggered the wheel feature. The dashed arrows 1510 represent bonus game symbol matrix positions in which symbols have not yet landed during the game instance that is represented by FIG. 15.

According to this example, the wheel feature presentation involves at least three spins of the wheel 1505. In the example shown in FIG. 15, in addition to triggering the wheel feature, the combination of at least (T−1) prize on symbols and at least one prize on trigger symbol also triggered one or more "hold and spin" bonus games. In some such examples, each spin of the wheel corresponds with a "hold and spin" bonus game. In some such examples, the result of each wheel spin affects the value of the prize on trigger symbol 1502 for a corresponding "hold and spin" bonus game.

Figure 16:
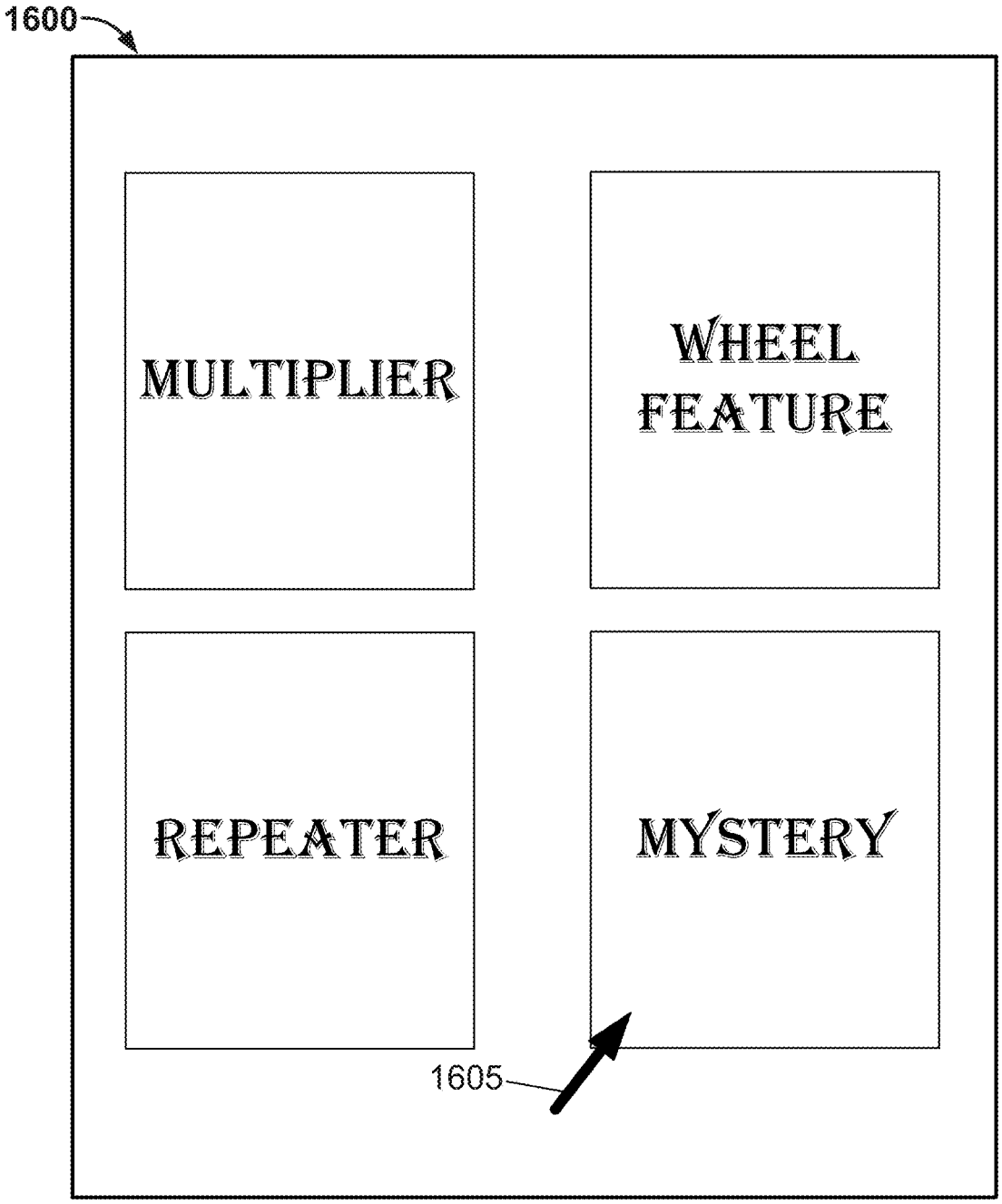
FIG. 16 shows an example of a graphical user interface (GUI) for selecting a prize on trigger symbol effect to be applied during the one or more "hold and spin" bonus games.

FIG. 16 shows an example of a graphical user interface (GUI) for selecting a prize on trigger symbol effect to be applied during the one or more "hold and spin" bonus games. In this example, the GUI 1600 is being presented after a prize on trigger symbol and at least (T−1) prize on symbols have landed during an instance of a base game, where T is a triggering number of prize on symbols if no prize on trigger symbol lands. According to this example, the prize on trigger symbol will be held for at least one of the one or more "hold and spin" bonus games and the prize on symbols of the base game will be held for all of the one or more "hold and spin" bonus games.

According to this example, prior to presentation of the one or more "hold and spin" bonus games, a control system (e.g., the control system 510 of FIG. 5) is configured for controlling a display system (e.g., the display system 505 of FIG. 5) to display a selection of prize on trigger symbol effects to be applied during the one or more "hold and spin" bonus games. In some instances, the GUI 1600 may include explanatory text, graphics, etc., indicating that the GUI 1600 is for the purpose of selecting a prize on trigger symbol effect to be applied during one or more subsequent "hold and spin" bonus games, the significance of each selection, etc. According to some implementations, the GUI 1600 may be accompanied by an audio and/or video presentation indicating the purpose of the GUI 1600, the significance of each selection, etc.

In this example, a user may select the effect of the prize on trigger symbol during the one or more "hold and spin" bonus games by interacting with a user interface, such as a touchscreen, track ball, one or more actual or virtual buttons, a mouse, etc., in order to position the arrow 1605 over a selected option and then may press the actual or virtual button, click on the mouse, etc., in order to indicate a user selection. In this example, a user may determine whether the prize on trigger symbol will be replaced with a multiplier symbol or a repeater symbol (e.g., as described above with reference to FIGS. 11 and 12), whether the value of the prize on trigger symbol will be determined by a wheel feature (e.g., as described above with reference to FIG. 15) or whether the value of the prize on trigger symbol will be determined according to a mystery feature. In some such examples, the mystery feature may be selected by a control system, e.g., according to a random number generator (RNG) call. The possible selections of the mystery feature may potentially include any of the effects of the prize on trigger symbol that are disclosed herein.

According to this example, the control system is configured for receiving, via the interface system, input corresponding to a player selection of a prize on trigger symbol effect to be applied during the one or more "hold and spin" bonus games. In this example, the control system is configured for applying the prize on trigger symbol effect during presentation of the one or more "hold and spin" bonus games.

Figure 17:
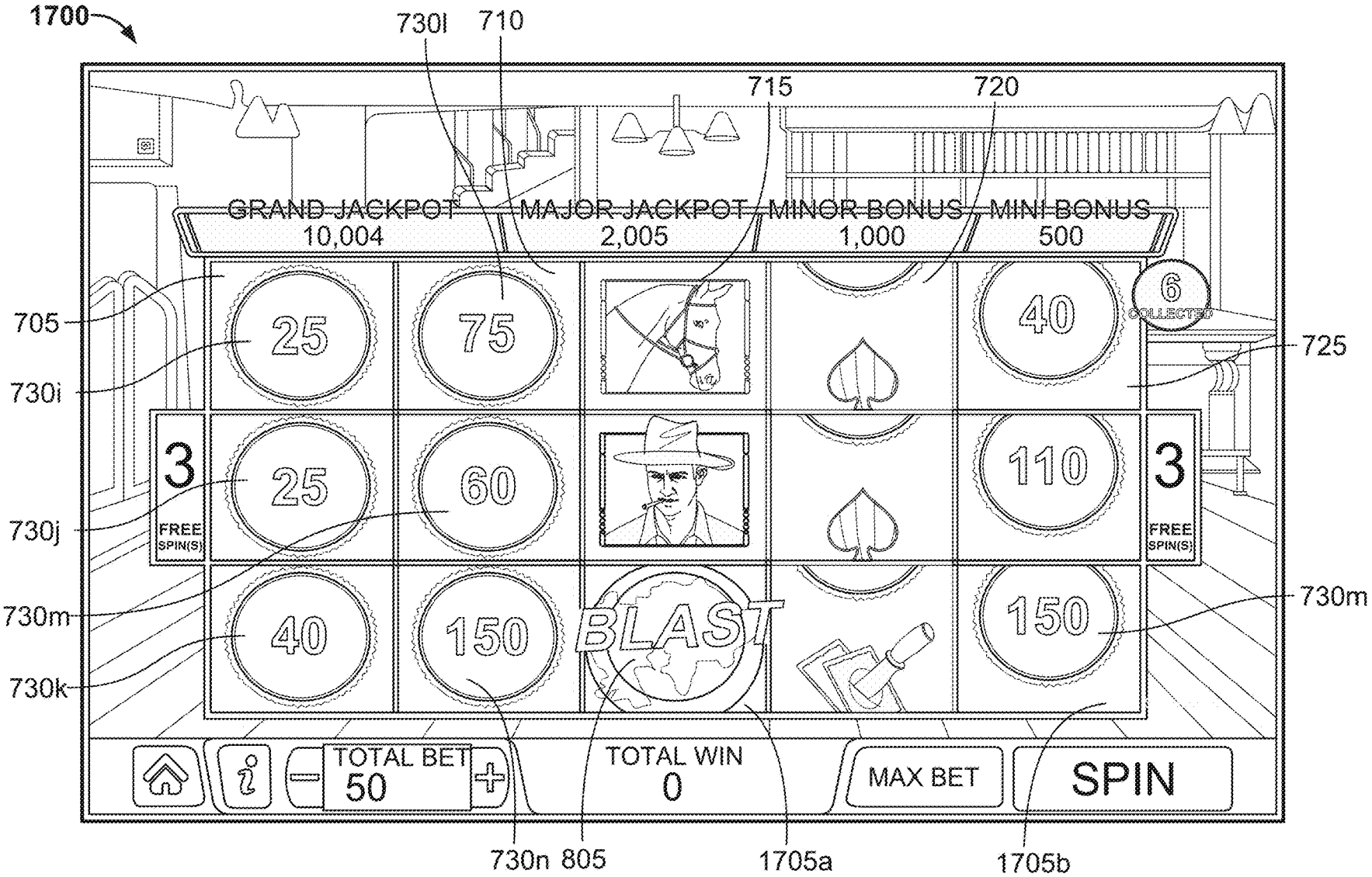
FIG. 17 shows an example of an image that may be displayed during a "hold and spin" bonus game.

FIG. 17 shows an example of an image that may be displayed during a "hold and spin" bonus game. In this example, prior to presenting the "hold and spin" bonus game, the control system had determined that one or more "hold and spin" bonus games were triggered when at least a threshold number of prize on symbols landed during an instance of a base game. Here, the threshold number was 6 and the prize on symbols that landed during the instance of the base game were prize on symbols **730*i*-730*n*. In the example shown in FIG. 17, a prize on trigger symbol did not land during the instance of the base game during which the prize on symbols 730*i*-730*n*** landed.

The image 1700 corresponds to an instant during which a control system is controlling a display to present the prize on symbols **730*i*-730*n* in static positions while symbols on the reels 715, 720 and 725 are presented as if they are moving and as if no symbol except the prize on trigger symbol 805 has dropped in the symbol area 1705*a*** during this "hold and spin" bonus game.

In the example shown in FIG. 17, each of the fifteen symbol areas 1705 functions as a reel, such that there are effectively fifteen reels instead of five reels. The "reels" 705-725 are, in effect, columns of three reels each.

Because the prize on trigger symbol 805 has dropped in the symbol area **1705*a*, in this example an award will be granted that will, at the least, be the sum of the game credits indicated on the prize on symbols 730*i*-730*n* (375 game credits). If the control system determines that one or more other prize on symbols will drop during this instance of the "hold and spin" game, in this example the value indicated by the other prize on symbols that drop will be added to the award. For example, if the prize on symbol 730*m* drops in the symbol area 1705*b*** during this instance of the game, the award will be 525 game credits, plus the value of any other prize on symbol that drops during this instance of the game.

In some "hold and spin" game implementations, each prize on symbol that drops during an instance of a game will be held during subsequent games, if any. After the final "hold and spin" game, in some such examples the value of all held prize on symbols will be awarded whether or not any prize on trigger symbol lands. In some implementations, if a threshold number of prize on symbols, including but not limited to held prize on symbols, are accumulated during a "hold and spin" bonus round, a jackpot may be awarded. According to some such implementations, a jackpot may be awarded if a prize on symbol lands in all of the active symbol areas 1705. In some implementations, the jackpot may be the highest-level jackpot available, which would be the Grand Jackpot in this example. According to some examples, a jackpot may be awarded if a prize on trigger symbol occupies one of the active symbol areas 1705 and a prize on symbol is displayed in all of the other active symbol areas 1705.

Figure 18:
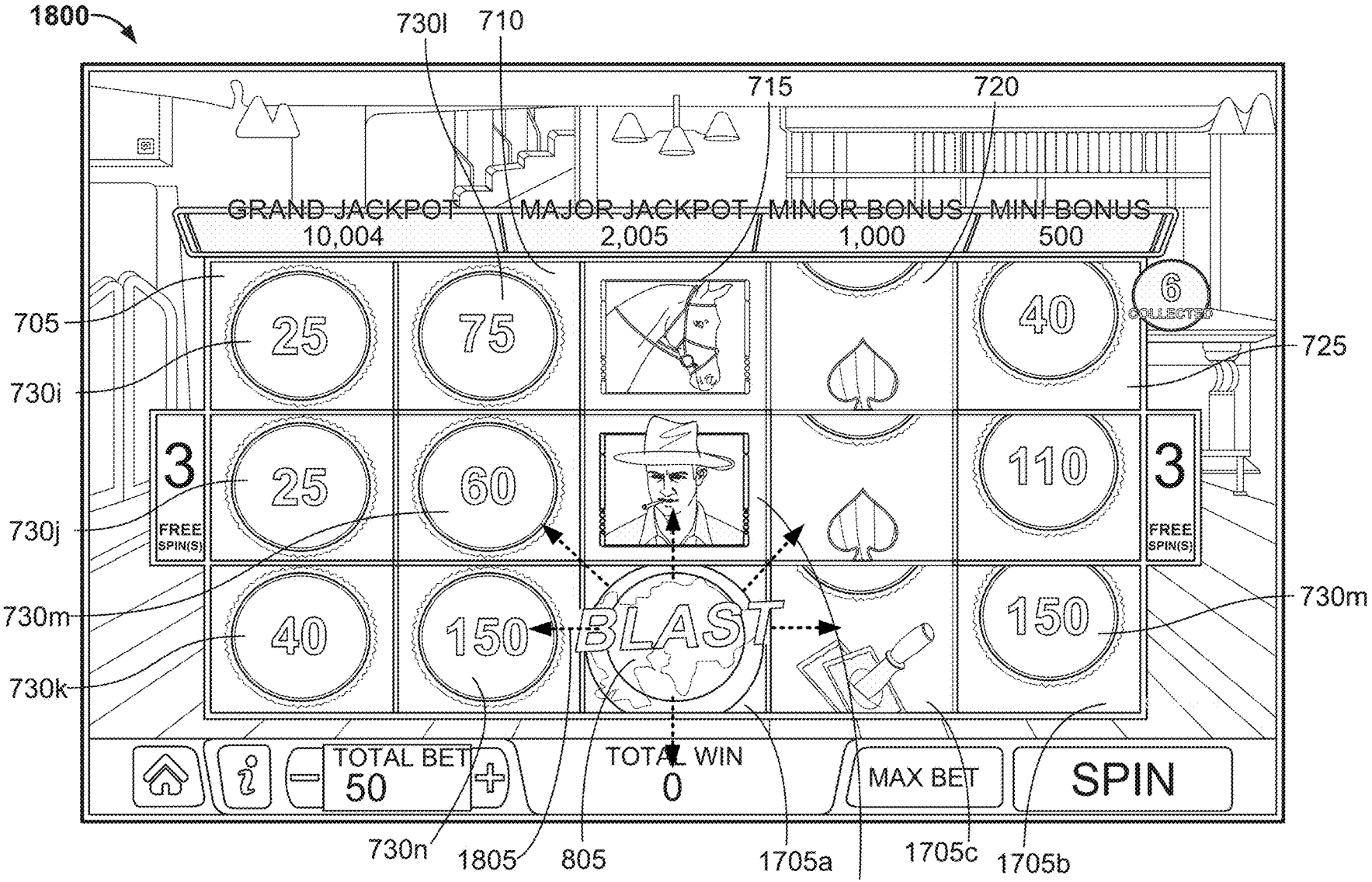
FIG. 18 shows another example of an image that may be displayed during a "hold and spin" bonus game.

FIG. 18 shows another example of an image that may be displayed during a "hold and spin" bonus game. In this example, prior to presenting the "hold and spin" bonus game, the control system had determined that one or more "hold and spin" bonus games were triggered when at least a threshold number of prize on symbols landed during an instance of a base game. Here, the threshold number was 6 and the prize on symbols that landed during the instance of the base game were prize on symbols 730*i*-730*n*.

However, unlike the situation depicted in the example shown in FIG. 17, in this example the prize on trigger symbol 805 also landed during the instance of the base game during which the prize on symbols 730*i*-730*n* landed. In this example, the prize on trigger symbol 805 will be held in the active symbol area 1705*a* for at least one of the one or more "hold and spin" bonus games. According to some implementations, the prize on trigger symbol 805 will be held in the active symbol area 1705*a* during presentation of F "hold and spin" bonus games, F being a number that is fewer than all of the one or more "hold and spin" bonus games. In some such implementations, a control system may be configured for controlling the display system to replace the prize on trigger symbol of the base game with another prize on symbol or with a prize-enhancing symbol (such as a multiplier symbol or a repeater symbol, e.g., as previously described) after presentation of the F "hold and spin" bonus games. In some examples, the prize on trigger symbol 805 will be held in the active symbol area 1705*a* for all of the one or more "hold and spin" bonus games.

According to some implementations, the control system may be configured for controlling the display system to display the prize on trigger symbol of the base game in a first bonus game symbol matrix position (e.g., the active symbol area 1705*a*) during presentation of a first "hold and spin" bonus game and in a second bonus game symbol matrix position during presentation of a second "hold and spin" bonus game. In some such examples, the second bonus game symbol matrix position may be adjacent to the first bonus game symbol matrix position, e.g., the active symbol area 1705*c* or the active symbol area 1705*d*.

In some examples, the second bonus game symbol matrix position may always be along the same trajectory, as suggested by the arrows 1805, which would not actually be displayed in this instance. For example, the prize on trigger symbol 805 may always move up in a subsequent "hold and spin" bonus game (e.g., in the direction of the active symbol area 1705*d* relative to the active symbol area 1705*a*), may always move to the right in a subsequent "hold and spin" bonus game (e.g., in the direction of the active symbol area 1705*c* relative to the active symbol area 1705*a*), etc. In some such implementations, the prize on trigger symbol 805 may always move down in a subsequent "hold and spin" bonus game. In such implementations, if the prize on trigger symbol 805 is initially displayed in the active symbol area 1705*a*, the prize on trigger symbol 805 may only be presented during the first "hold and spin" bonus game. In some examples, only the values of prize on symbols that are "covered" by the moving prize on trigger symbol 805 will be awarded. In other implementations examples, only the values of prize on symbols that are not "covered" by the moving prize on trigger symbol 805 will be awarded.

Figure 19:
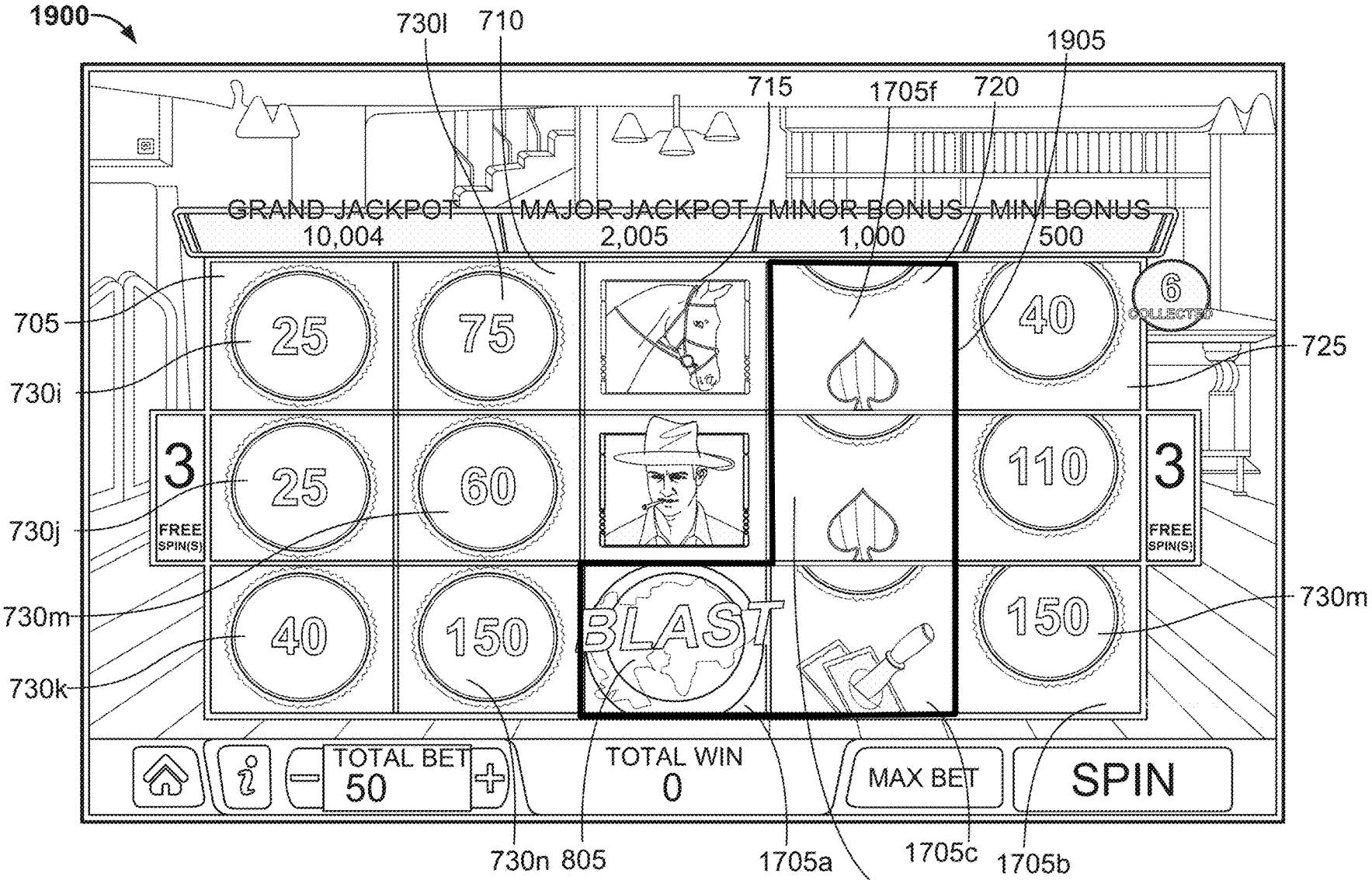
FIG. 19 shows another example of an image that may be displayed during a "hold and spin" bonus game.

FIG. 19 shows another example of an image that may be displayed during a "hold and spin" bonus game. In this example, prior to presenting the "hold and spin" bonus game, the control system had determined that one or more "hold and spin" bonus games were triggered when at least a threshold number of prize on symbols landed during an instance of a base game. Here, the threshold number was 6 and the prize on symbols that landed during the instance of the base game were prize on symbols 730*i*-730*n*.

In this example, the prize on trigger symbol 805 also landed during the instance of the base game during which the prize on symbols 730*i*-730*n* landed. In this example, the prize on trigger symbol 805 will be held in the active symbol area 1705*a* for at least one of the one or more "hold and spin" bonus games. However, according to some implementations, the prize on trigger symbol 805 may move in subsequent "hold and spin" bonus games, e.g., as described above with reference to FIG. 18.

In the example shown in FIG. 19, the control system is configured for determining a bonus game award that includes a combined value of all prize on symbols that are displayed in the bonus game symbol matrix portion 1905 (which is shown with a solid black outline in the presentation 1900, encompassing the active symbol areas 1705*a*, 1705*c*, 1705*e* and 1705*f*) during the outcome of each individual "hold and spin" bonus game during which the prize on trigger symbol of the base game is displayed in the fixed position. In this example, the bonus game symbol matrix portion 1905 is a geometric pattern of bonus game symbol positions. In other examples, the bonus game symbol matrix portion 1905 may be a different geometric pattern of bonus game symbol positions.

However, in other implementations, the bonus game symbol matrix portion may correspond to one or more bonus game symbol matrix rows (e.g., the symbol matrix row in which the prize on trigger symbol 805 is held, or the symbol matrix row that includes the initial position of the prize on trigger symbol 805), to one or more bonus game symbol matrix columns (e.g., the symbol matrix column 715, in which the prize on trigger symbol 805 is held, or the symbol matrix column that includes the initial position of the prize on trigger symbol 805), or one or more bonus game symbol matrix positions adjacent to a bonus game symbol matrix position of the prize on trigger symbol of the base game (e.g., all of the bonus game symbol matrix positions adjacent to the active symbol area 1705*a*).

According to some examples, the control system is configured for determining a bonus game award that includes a multiple (e.g., 2×, 3×, 4×, 5×, etc.) of the combined value of all prize on symbols that are displayed in the bonus game symbol matrix portion. The bonus game award may or may not include the value of prize on symbols that are displayed outside of the bonus game symbol matrix portion, depending on the particular implementation.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

The invention claimed is:

1. An electronic gaming machine, comprising:

a display system including one or more displays;

an interface system including one or more user interfaces; and a control system including one or more processors, the control system being configured for:

determining, for a game outcome for an instance of a base game, which symbols will be presented on the display system by selecting the symbols to be presented from a symbol set that includes prize on symbols and at least one prize on trigger symbol, each prize on symbol including an indication of an award corresponding to the prize on symbol, a combined value of prize on symbols being payable at a conclusion of a feature game round;

controlling the display system to present first visual effects corresponding to the game outcome, the first visual effects including moving symbols and landing of one or more prize on symbols;

determining an award corresponding to the game outcome, wherein determining the award involves:

for a game outcome in which the control system determines that the game outcome includes a prize on trigger symbol, determining that the award includes a combined value of the one or more prize on symbols; and for a game outcome in which the control system determines that the game outcome does not include the prize on trigger symbol, determining that the award does not include the combined value of the one or more prize on symbols; and controlling the display system to present second visual effects corresponding to the award.

2. The electronic gaming machine of claim 1, wherein:

the control system determines that a prize on trigger symbol lands during an instance of the base game in which a feature is triggered; and the control system is configured for controlling the display system to present the feature.

3. The electronic gaming machine of claim 2, wherein:

the control system determines that (T−1) prize on symbols land during the instance of the base game, (T−1) corresponding to a number that is one less than a threshold number T of prize on symbols required to trigger a feature;

the control system determines that a prize on trigger symbol lands during the instance of the base game;

the control system determines that a combination of the prize on trigger symbol and the (T−1) prize on symbols will trigger the feature; and the control system is configured for controlling the display system to present the feature.

4. The electronic gaming machine of claim 2, wherein:

the control system determines that at least T prize on symbols land during the instance of the base game, T corresponding to a threshold number of prize on symbols required to trigger a feature;

the control system determines that a prize on trigger symbol lands during the instance of the base game;

the control system determines that the at least T prize on symbols will trigger the feature; and the control system is configured for controlling the display system to present the feature.

5. The electronic gaming machine of claim 2, wherein the feature that is triggered when the prize on trigger symbol lands during the instance of the base game in which the feature is triggered is an enhanced version of a feature that would be triggered by a game outcome in which no prize on trigger symbol lands.

6. The electronic gaming machine of claim 2, wherein the feature that is triggered when the prize on trigger symbol lands during the instance of the base game in which the feature is triggered is different from a feature that would be triggered by a game outcome wherein no prize on trigger symbol lands.

7. The electronic gaming machine of claim 2, wherein the feature includes one or more "hold and spin" bonus games and wherein the control system is configured for controlling the display system to display the prize on symbols and the prize on trigger symbol of the base game in fixed positions during presentation of at least one of the one or more "hold and spin" bonus games.

8. A method of controlling an electronic gaming machine, the method comprising:

determining, for a game outcome for an instance of a base game and via a control system of an electronic gaming machine that is presenting the game, which symbols will be presented on a display system of the electronic gaming machine by selecting the symbols to be presented from a symbol set that includes prize on symbols and at least one prize on trigger symbol, each prize on symbol including an indication of an award corresponding to the prize on symbol, a combined value of prize on symbols being payable at a conclusion of a feature game round;

controlling, via the control system, the display system to present first visual effects corresponding to the game outcome, the first visual effects including moving symbols and landing of one or more prize on symbols;

determining, via the control system, an award corresponding to the game outcome, wherein determining the award involves:

for a game outcome in which the control system determines that the game outcome includes a prize on trigger symbol, determining that the award includes a combined value of the one or more prize on symbols; and for a game outcome in which the control system determines that the game outcome does not include the prize on trigger symbol, determining that the award does not include the combined value of the one or more prize on symbols; and controlling, via the control system, the display system to present second visual effects corresponding to the award.

9. The method of claim 8, further comprising:

determining, via the control system, that a prize on trigger symbol lands during an instance of the base game in which a feature is triggered; and controlling, via the control system, the display system to present the feature.

10. The method of claim 9, further comprising:

determining, via the control system, that (T−1) prize on symbols land during the instance of the base game, (T−1) corresponding to a number that is one less than a threshold number T of prize on symbols required to trigger a feature;

determining, via the control system, that a prize on trigger symbol lands during the instance of the base game; and determining, via the control system, that a combination of the prize on trigger symbol and the (T−1) prize on symbols will trigger the feature.

11. The method of claim 9, further comprising:

determining, via the control system, that at least T prize on symbols land during the instance of the base game, T corresponding to a threshold number of prize on symbols required to trigger a feature;

determining, via the control system, that a prize on trigger symbol lands during the instance of the base game; and determining, via the control system, that the at least T prize on symbols will trigger the feature.

12. The method of claim 9, wherein the feature that is triggered when the prize on trigger symbol lands during the instance of the base game in which the feature is triggered is an enhanced version of a feature that would be triggered by a game outcome in which no prize on trigger symbol lands.

13. The method of claim 9, wherein the feature that is triggered when the prize on trigger symbol lands during the instance of the base game in which the feature is triggered is different from a feature that would be triggered by a game outcome wherein no prize on trigger symbol lands.

14. The method of claim 9, wherein:

the feature includes one or more "hold and spin" bonus games, the method further includes controlling, via the control system, the display system to display the prize on symbols and the prize on trigger symbol of the base game in fixed positions during presentation of at least one of the one or more "hold and spin" bonus games.

15. One or more non-transitory media having software stored thereon, the software including instructions for a method of controlling an electronic gaming machine, the method comprising:

determining, for a game outcome for an instance of a base game and via a control system of an electronic gaming machine that is presenting the game, which symbols will be presented on a display system of the electronic gaming machine by selecting the symbols to be presented from a symbol set that includes prize on symbols and at least one prize on trigger symbol, each prize on symbol including an indication of an award corresponding to the prize on symbol, a combined value of prize on symbols being payable at a conclusion of a feature game round;

controlling, via the control system, the display system to present first visual effects corresponding to the game outcome, the first visual effects including moving symbols and landing of one or more prize on symbols;

determining, via the control system, an award corresponding to the game outcome, wherein determining the award involves:

for a game outcome in which the control system determines that the game outcome includes a prize on trigger symbol, determining that the award includes a combined value of the one or more prize on symbols; and for a game outcome in which the control system determines that the game outcome does not include the prize on trigger symbol, determining that the award does not include the combined value of the one or more prize on symbols; and controlling, via the control system, the display system to present second visual effects corresponding to the award.

16. The one or more non-transitory media of claim 15, wherein the method further comprises:

determining, via the control system, that a prize on trigger symbol lands during an instance of the base game in which a feature is triggered; and controlling, via the control system, the display system to present the feature.

17. The one or more non-transitory media of claim 16, wherein the method further comprises:

determining, via the control system, that (T−1) prize on symbols land during the instance of the base game, (T−1) corresponding to a number that is one less than a threshold number T of prize on symbols required to trigger a feature;

determining, via the control system, that a prize on trigger symbol lands during the instance of the base game; and determining, via the control system, that a combination of the prize on trigger symbol and the (T−1) prize on symbols will trigger the feature.

18. The one or more non-transitory media of claim 16, wherein the method further comprises:

determining, via the control system, that at least T prize on symbols land during the instance of the base game, T corresponding to a threshold number of prize on symbols required to trigger a feature;

determining, via the control system, that a prize on trigger symbol lands during the instance of the base game; and determining, via the control system, that the at least T prize on symbols will trigger the feature.

19. The one or more non-transitory media of claim 16, wherein the feature that is triggered when the prize on trigger symbol lands during the instance of the base game in which the feature is triggered is an enhanced version of a feature that would be triggered by a game outcome in which no prize on trigger symbol lands.

20. The one or more non-transitory media of claim 16, wherein the feature that is triggered when the prize on trigger symbol lands during the instance of the base game in which the feature is triggered is different from a feature that would be triggered by a game outcome wherein no prize on trigger symbol lands.

21. The one or more non-transitory media of claim 16, wherein:

the feature includes one or more "hold and spin" bonus games, the method further includes controlling, via the control system, the display system to display the prize on symbols and the prize on trigger symbol of the base game in fixed positions during presentation of at least one of the one or more "hold and spin" bonus games.

* * * * *